US007357388B2

(12) United States Patent
Dan

(10) Patent No.: US 7,357,388 B2
(45) Date of Patent: Apr. 15, 2008

(54) IMAGE FORMING APPARATUS WITH RECORDING MEDIUM SUPPORT MEMBER ADJUSTABLE IN POSITION FOR DESIRED POSITION OF UPPERMOST RECORDING MEDIUM ON SUPPORT MEMBER

(75) Inventor: Kenichi Dan, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 530 days.

(21) Appl. No.: 11/090,121

(22) Filed: Mar. 28, 2005

(65) Prior Publication Data

US 2005/0218584 A1 Oct. 6, 2005

(30) Foreign Application Priority Data

Mar. 31, 2004 (JP) ..... 2004-107320

(51) Int. Cl.
*B65H 1/08* (2006.01)

(52) U.S. Cl. ..... 271/127; 271/147; 271/157

(58) Field of Classification Search ..... 271/127, 271/147, 157
See application file for complete search history.

(56) References Cited

U.S. PATENT DOCUMENTS 4,025,066 A * 5/1977 Sue ..... 271/9.08
5,501,444 A 3/1996 Yukimachi et al.
5,621,452 A * 4/1997 Okumura ..... 347/171
5,775,686 A * 7/1998 Miyake ..... 271/127
6,042,099 A * 3/2000 Takagishi ..... 271/2
6,260,840 B1 * 7/2001 Suga et al. ..... 271/10.12
6,354,584 B1 * 3/2002 Suga et al. ..... 271/10.12
6,609,707 B1 * 8/2003 Yano ..... 271/10.05

FOREIGN PATENT DOCUMENTS

| | | |
|---|---|---|
| JP | A 7-053065 | 2/1995 |
| JP | A 8-12105 | 1/1996 |
| JP | A 9-86680 | 3/1997 |
| JP | B2 2698535 | 9/1997 |
| JP | A 2001-96791 | 4/2001 |
| JP | A 2003-292172 | 10/2003 |

* cited by examiner

*Primary Examiner*—Patrick Mackey
*Assistant Examiner*—Howard Sanders
(74) *Attorney, Agent, or Firm*—Oliff & Berridge, PLC

(57) ABSTRACT

An apparatus for forming an image on a recording medium is disclosed which includes: a first drive source; a photoreceptor driven for movement by a driving force applied thereto from the first drive source; a support member supporting the recording medium to be fed toward the photoreceptor, displaceable between a receiving position allowing reception of the recording medium on the support member, and a feeding position allowing feeding of the recording medium from the support member toward the photoreceptor; and a drive mechanism operable by a driving force applied thereto from the first drive source to displace the support member from the receiving position to the feeding position.

21 Claims, 15 Drawing Sheets

IMAGE FORMING APPARATUS WITH RECORDING MEDIUM SUPPORT MEMBER ADJUSTABLE IN POSITION FOR DESIRED POSITION OF UPPERMOST RECORDING MEDIUM ON SUPPORT MEMBER

This application is based on Japanese Patent Application No. 2004-107320 filed Mar. 31, 2004, the content of which is incorporated hereinto by reference.

CROSS-REFERENCE TO RELATED APPLICATIONS

Not Applicable.

BACKGROUND OF THE INVENTION

1. Field of the Invention

The invention relates to a technique of forming an image on a recording medium which is supported by a support member and which is to be fed to a photoreceptor, and more particularly to a technique of adjusting the position of the support member for a desired position of an uppermost recording medium on the support member.

2. Description of the Related Art

In general, image forming apparatuses such as printers are each configured to include a feeder tray for feeding a recoding medium in the form of a recording sheet of paper, for example. The feeder tray includes a sheet pressure plate on which a stack of recording sheets are received, or onto which a stack of recording sheets are loaded, and a pick-up roller for picking up from the feeder tray an uppermost one of the recording sheets stacked on the sheet pressure plate.

In the above-mentioned image forming apparatuses, the sheet pressure plate is supported to allow a pivotal movement thereof about the axis of one of both ends of the sheet pressure plate remote from the pick-up roller. One of the both ends of the sheet pressure plate adjacent to the pick-up roller is spring biased toward a feed roller. This arrangement permits the uppermost recording sheet to be pressed onto the pick-up roller and to be fed because of rotation of the pick-up roller.

The sheet pressure plate bears the weight of the recording sheets on the sheet pressure plate, the magnitude of which depends on the number and the sizes of the recording sheets on the sheet pressure plate.

For the above reasons, the feeder tray having the above-described configuration introduces variations in magnitude of a pressing force acting between the recording sheets received on the sheet pressure plate and the pick-up roller in pressing contact with each other, depending on the number and the sizes of the recording sheets received on the sheet pressure plate.

Such variations in pressing force may cause an unintended event such as double sheet feed (multi-sheet feed) or sheet misfeed (sheet miss feed) of the recording sheets from the feeder tray. More specifically, if the pressing force is larger than desired, double sheet feed occurs in which multi recording sheets are fed out together from the feeder tray in superposed relationship, while, if the pressing force is smaller than desired, sheet misfeed occurs in which no recording sheet is fed out from the feeder tray despite of rotation of the pick-up roller.

In the feeder tray having the above-described configuration, each time that the individual recording sheets are picked up from the feeder tray one sheet at a time by the pick-up roller, the uppermost one of the recording sheets on the sheet pressure plate is brought into pressing contact with the pick-up roller, with the sheet pressure plate being slightly oscillated. For this reason, the above-described configuration may also invite a noisy operation of the feeder tray during its continuous feeding operation of recording sheets.

For example, Japanese Patent No. 2698535 discloses a configuration in which a drive source moves a sheet receiver receiving sheets by virtue of a driving force applied from the drive source, from a position with the sheets on the sheet receiver being apart from a pick-up roller, to a position with an uppermost one of the sheets on the sheet receiver being in contact with the pick-up roller, to thereby retain the uppermost sheet at a given position relative to the pick-up roller.

BRIEF SUMMARY OF THE INVENTION

However, the above configuration disclosed in the above Japanese Patent, when practiced with an additional drive source for displacing the sheet receiver in combination with an existing drive source, invites an increase in manufacturing cost.

It is therefore an object of the present invention to provide an image forming apparatus facilitating improvement in feeding accuracy of a recording medium and reduction in noise during continuous feeding operation of recording media.

According to the present invention, an apparatus for forming an image on a recording medium, comprising:

a first drive source;

a photoreceptor driven for movement by a driving force applied thereto from the first drive source;

a support member supporting the recording medium to be fed toward the photoreceptor, displaceable between a receiving position allowing reception of the recording medium on the support member, and a feeding position allowing feeding of the recording medium from the support member toward the photoreceptor; and a drive mechanism operable by a driving force applied thereto from the first drive source to displace the support member from the receiving position to the feeding position.

The above apparatus allows the first drive source to displace the support member by virtue of a driving force of the first drive source, from the receiving position to the feeding position, resulting in the recording medium on the support member being pressed under a substantially constant pressing force onto a feeding element such as a pick-up roller for feeding out the recording medium from the support member toward the photoreceptor. This facilitates improvement in feeding accuracy of the recording medium and reduction in noise during continuous feeding operation of a plurality of recording medium.

The above apparatus also allows the driving force of the first drive source to apply to both the photoreceptor and the support member, enabling the first drive source to function as a drive source common to both these photoreceptor and support member. This eliminates an increase in manufacturing cost.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities show. In the drawings.

DETAILED DESCRIPTION OF THE INVENTION

Figure 1:
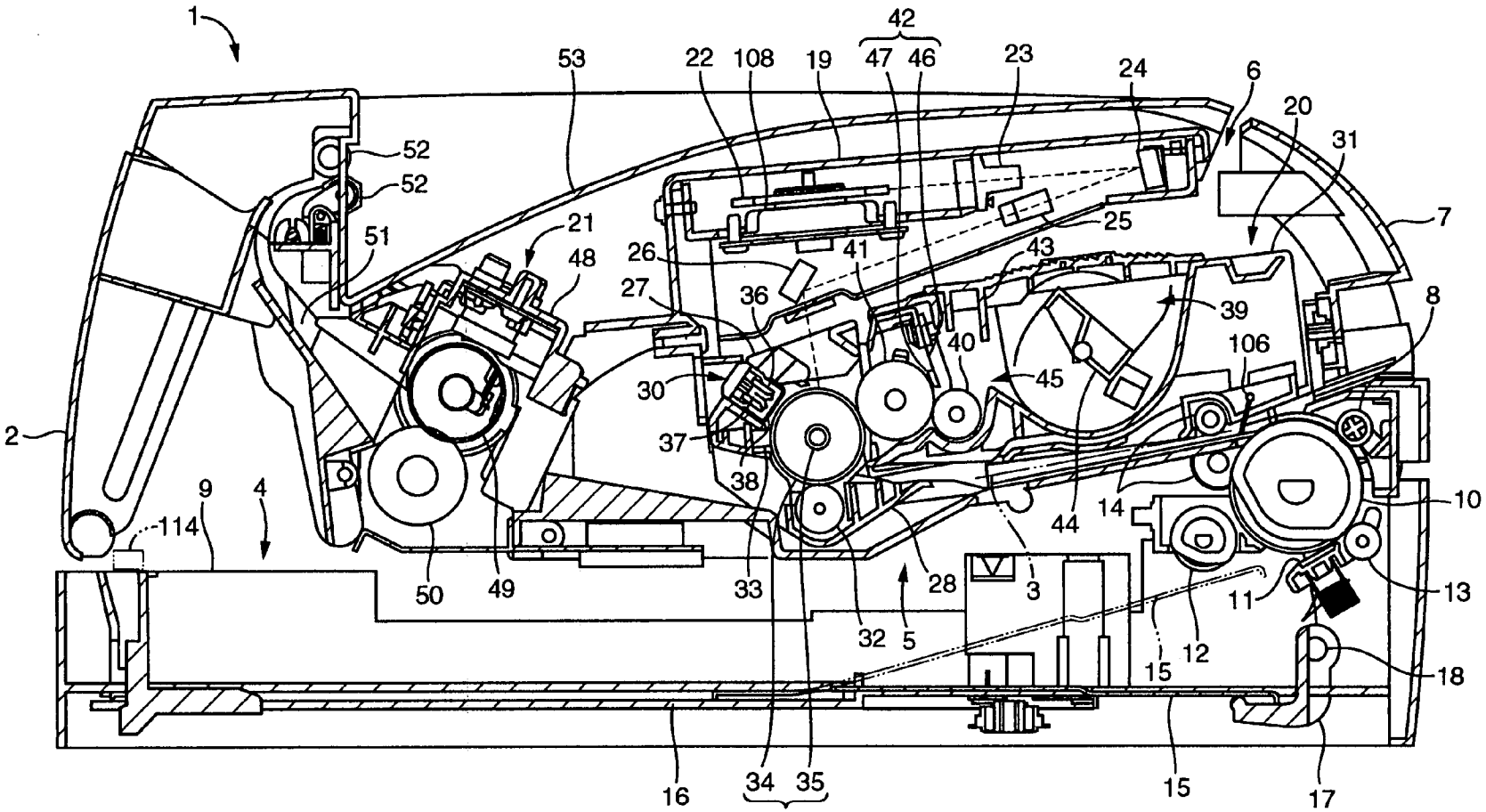
FIG. 1 is a sectional side view illustrating a relevant portion of a laser printer as an image forming apparatus according to a first embodiment of the present invention.

The object mentioned above may be achieved according to any one of the following modes of this invention.

These modes will be stated below such that these modes are sectioned and numbered, and such that these modes depend upon the other mode or modes, where appropriate. This is for a better understanding of some of a plurality of technological features and a plurality of combinations thereof disclosed in this description, and does not mean that the scope of these features and combinations is interpreted to be limited to the scope of the following modes of this invention.

That is to say, it should be interpreted that it is allowable to select the technological features which are stated in this description but which are not stated in the following modes, as the technological features of this invention.

Furthermore, stating each one of the selected modes of the invention in such a dependent form as to depend from the other mode or modes does not exclude a possibility of the technological features in a dependent-form mode to become independent of those in the corresponding depended mode or modes and to be removed therefrom. It should be interpreted that the technological features in a dependent-form mode is allowed to become independent according to the nature of the corresponding technological features, where appropriate.

(1) An apparatus for forming an image on a recording medium, comprising:

a first drive source;

a photoreceptor driven for movement by a driving force applied thereto from the first drive source;

a support member supporting the recording medium to be fed toward the photoreceptor, displaceable between a receiving position allowing reception of the recording medium by the support member, and a feeding position allowing feeding of the recording medium from the support member toward the photoreceptor; and a drive mechanism operable by a driving force applied thereto from the first drive source to displace the support member from the receiving position to the feeding position.

The apparatus according to the above mode (1) allows the driving force of the first drive source to be employed to displace the support member from the receiving position to the feeding position, resulting in the recording medium on the support member being pressed under a substantially constant pressing force onto a feeding element such as a pick-up roller for feeding out the recording medium from the support member toward the photoreceptor. This facilitates improvement in feeding accuracy of the recording medium and reduction in noise during continuous feed of a plurality of recording media.

The apparatus according to the above mode (1) also allows the driving force of the first drive source to apply to both the photoreceptor and the support member, enabling the first drive source to function as a drive source common to both these photoreceptor and support member. This eliminates increase in manufacturing cost.

(2) The apparatus according to mode (1), wherein the drive mechanism selectively employs the driving force applied from the first drive source, depending on a position of the support member, to thereby displace the support member toward the feeding position.

The apparatus according to the above mode (2) allows the relationship in operation between the first drive source and the support member to be changed depending on the position of the support member, to thereby achieve desired changes in position of the support member.

(3) The apparatus according to mode (2), wherein the support member receives a stack of a plurality of recording sheets, each corresponding to the recording medium, and wherein the drive mechanism comprises:

an input member driven by the first drive source;

an output member allowing displacement of the support member;

a clutch disposed between the input member and the output member, operable to be selectively switched to a state allowing transmission of a driving force of the input member to the output member, and a state not allowing the transmission; and an actuator operable to switch the operation state of the clutch depending on a position of an uppermost one of the plurality of recording sheets stacked on the support member.

The apparatus according to the above mode (3) provides a preferred example of a mechanical connection between the first drive source and the support member using an actuator responsive to the position of the recording medium and a clutch responsive to the actuator.

(4) The apparatus according to mode (3), wherein the input member comprises an input shaft rotated about an axis thereof, wherein the clutch comprises a reducer of an eccentric differential type having an external gear and an internal gear which are different in number of teeth from each other and which mesh eccentrically with each other, and wherein the actuator selectively switches a relative geometry between the external and internal gears into a geometry allowing a relative rotation therebetween and a geometry not allowing the relative rotation.

The apparatus according to the above mode (4) provides a preferred example of a combination of the clutch and the actuator both set forth in the above mode (3).

(5) The apparatus according to mode (4), wherein the external gear is rotatable relative to the input shaft in eccentric relation thereto, and is mechanically engaged with the output shaft, wherein the internal gear is rotatable coaxially with the input shaft, and meshes with the external gear with the internal gear being larger in number of teeth than the external gear, and wherein the actuator selectively switches a state of the internal gear to a state not allowing an integral rotation of the internal and external gears, and a state allowing the integral rotation.

The apparatus according to the above mode (5) provides a preferred example of the cooperative operation of the external and internal gears in meshing engagement with each other and the actuator, the external and internal gears and the actuator being set forth in the above mode (4).

(6) The apparatus according to any one of modes (1)-(5), further including a controller controlling a driving speed of the first drive source to achieve a first driving speed while the recording medium is being fed, and a second driving speed lower than the first driving speed while the support member is being displaced from the receiving position to the feeding position.

The apparatus according to the above mode (6) allows the support member to be displaced from the receiving position to the feeding position at a reduced speed by the direction of the controller. This facilitates improvement in the accuracy with which the support member is positioned at the feeding position without shortening the life of the photoreceptor, for the reasons described below.

An increase in gear ratio of a transmission gear allowing transmission of the driving force of the first drive source to the drive mechanism permits a decrease in moving speed of the support member. However, an increase in gear ratio of the transmission gear induces an increase in amount of a driving operation of the first drive source required for displacing the support member from the receiving position to the feeding position, additionally inviting an increase in amount of movement of the photoreceptor. The photoreceptor is driven together with the support member by the driving force of the first drive source.

In general, a photoreceptor such as a photosensitive drum is moved in contact with a peripheral such as a brush, and therefore, the longer the photoreceptor moves, the more the photoreceptor is degraded. As a result, an increase in the gear ratio of the aforementioned transmission gear causes a shortened life of the photoreceptor.

In the apparatus according to the above mode (6), a reduction in moving speed of the support member, which is conducive to an improvement in accuracy of positioning the support member at the feeding position, is accomplished by reduction in driving speed of the first drive source. The reduction in driving speed of the first drive source does not require an increase in amount of movement of the photoreceptor experienced during the displacement of the support member from the receiving position to the feeding position. That is, the amount of movement of the photoreceptor remains unchanged.

With this in mind, the apparatus according to the above mode (6) is configured such that the driving speed of the first drive source is reduced for reducing the moving speed of the support member, without shortening the life of the photoreceptor, resulting in an increase in accuracy in positioning the support member at the feeding position.

(7) The apparatus according to mode (6), further comprising:

a second drive source; and an optical element driven by the second drive source for scanning the photoreceptor with laser light, to thereby form an electrostatic latent image on the photoreceptor, wherein the photoreceptor carries thereon a developer image resulting from development of the electrostatic latent image, wherein the developer image is transferred from the photoreceptor to the recording medium delivered to the photoreceptor, at a point of time of transfer established based on a length of a scanning readiness period elapsed from a time at which a driving operation of the second drive source starts to a time at which the driving speed of the second drive source reaches a speed allowing scanning of the photoreceptor with the laser light using the optical element, wherein feed of the recording medium from the support member toward the photoreceptor starts at a start time of feed allowing that the recording medium reaches the photoreceptor by the point of time of transfer, and wherein displacement of the support member from the receiving position toward the feeding position at the second driving speed starts at a start time of displacement allowing that the recording medium reaches the feeding position by the start time of feed.

The apparatus according to the above mode (7) permits completion of both the displacement of the support member from the receiving position to the feeding position, and the subsequent event, i.e., feed or transport of the recording medium from the support member to the photoreceptor, by the point of time of transfer established by allowing for the scanning readiness period.

For this reason, the apparatus according to the above mode (7) prevents a delay of the point of time of transfer due to the setting of the driving speed of the first drive source to the second driving speed lower than the first driving speed during the displacement of the support member from the receiving to the feeding position.

The apparatus according to the above mode (7) therefore allows the transfer of a developer image onto the recording medium to be completed within the same period as with the case where the driving speed of the first drive source is set to the first driving speed higher than the second driving speed during the displacement of the support member from the receiving to the feeding position.

(8) The apparatus according to mode (7), wherein the first and second drive sources start driving operations at different points of time, respectively.

The apparatus according to the above mode (8), owing to the existence of a difference in start time of a driving operation between the first and second drive sources, prevents an increase in instantaneous load on a common power source unit for supplying power to both the first and second drive sources.

The apparatus according to the above mode (8) therefore allows a stabilized power supply of the power source unit to the first and the second drive source, resulting in stabilized operations of the first and the second drive source.

(9) The apparatus according to mode (7) or (8), wherein the start time of displacement and the start time of feed are each established to be reached within the scanning readiness period.

For enabling a recording medium to reach the photoreceptor by the point of time of transfer, if the start time of displacement is set to a time before a start time at which a driving operation of the second drive source starts, a time length is prolonged which is required for forming an image and which is elapsed from a start point of an image forming operation to a point of time at which a developer image is transferred onto the recording medium.

In contrast, the apparatus according to the above mode (9), because of the setting of both the start time of the displacement and the start time of feed to a time after a start time at which a driving operation of the second drive source starts, prevents a prolongation of the time length required for forming an image.

(10) The apparatus according to mode (9), further comprising:

a transfer device transferring the developer image from the photoreceptor onto the recording medium; and a transfer-bias applicator applying to the transfer device a selected one of a transfer bias and a transfer cleaning bias, wherein the controller applies the transfer cleaning bias to the transfer device via the transfer bias applicator prior to the start time of feed within the scanning readiness period, to thereby complete a cleaning operation for cleaning the transfer device.

The apparatus according to the above mode (10) allows the cleaning of the transfer device to be completed by the start time of feed of the recording medium from the support member toward the photoreceptor. The apparatus therefore allows the application of the transfer bias to the transfer device during feeding of the recording medium from the support member toward the photoreceptor, with a stabilized transfer of the developer image onto the recording medium.

(11) The apparatus according to mode (10), wherein the controller applies the transfer bias to the transfer device via the transfer bias applicator concurrently with or after the start time of feed.

The apparatus according to the above mode (11) prevents an application of the transfer bias to the transfer device prior to the start time of feed of the recording medium from the support member toward the photoreceptor, and therefore prevents a long-time application of the transfer bias to the transfer device, resulting in a prolonged life and improved durability of the transfer device.

(12) The apparatus according to any one of modes (7)-(11), further comprising a cleaner cleaning the photoreceptor by applying a photoreceptor cleaning bias to the photoreceptor, wherein the controller applies the photoreceptor cleaning bias to the photoreceptor via the cleaner prior to the start time of feed within the scanning readiness period.

The apparatus according to the above mode (12) allows the application of the photoreceptor cleaning bias to the cleaner to be initiated prior to the start time of feed of the recording medium from the support member toward the photoreceptor. The apparatus therefore allows the cleaning of the photoreceptor to be completed by a time at which the scanning of the photoreceptor with the laser light is initiated, resulting in a confident formation of an electrostatic latent image on the photoreceptor.

(13) The apparatus according to any one of modes (7)-(12), wherein the controller switches the driving speed of the first drive source from the second driving speed to the first driving speed, upon completion of displacement of the support member to the feeding position, by the start time of feed of the recording medium.

The apparatus according to the above mode (13) allows the first drive source to be driven at the first driving speed lower than the second driving speed, by the start time of feed of the recording medium from the support member toward the photoreceptor, and therefore allows the photoreceptor to be moved at a speed depending upon the first driving speed, with an improved registration accuracy in transferring a developer image onto the recording medium.

(14) The apparatus according to any one of modes (6)-(13), wherein the controller controls the driving speed of the first drive source to achieve the first driving speed with the support member being located at the feeding position.

The apparatus according to the above mode (14) prevents a reduction in driving speed of the first drive source to the second driving speed, where the support member has been displaced to the feeding position, that is to say, where there is no need to displace the support member.

(15) The apparatus according to mode (14), further comprising:

a storage storing a developer material for developing an electrostatic latent image formed on the photoreceptor; and an agitator agitating the developer material stored in the storage, wherein the controller determines that the support member is located at the feeding position within a predetermined length of time elapsed after operation of the agitator for warming up the storage.

In general, the operation of the agitator for warming up the storage is performed immediately before the feed of the recording medium from the support member toward the photoreceptor. Therefore, it can be predicted that the support member is located at the feeding position within a predetermined length of time elapsed after the above operation of the agitator for warming up the storage.

In view of the above findings, the apparatus according to the above mode (15) determines that the support member is located at the feeding position within a predetermined length of time elapsed after the above operation of the agitator for warming up the storage, fostering a correct determination as to whether or not the support member is located at the feeding position.

(16) The apparatus according to mode (14) or (15), wherein the controller determines that the support member is located at the feeding position within a predetermined length of time elapsed after operation of the apparatus for forming an image on the recording medium.

In general, the displacement of the support member from the feeding to the receiving position is not experienced within a short period after completion of the image forming operation. Therefore, it can be predicted that the support member is located at the feeding position within a predetermined length of time elapsed after the operation of the instant apparatus for forming an image on the recording medium.

In view of the above findings, the apparatus according to the above mode (16) determines that the support member is located at the feeding position within a predetermined length of time elapsed after operation of the instant apparatus for forming an image on the recording medium, fostering a correct determination as to whether or not the support member is located at the feeding position.

(17) The apparatus according to any one of modes (14)-(16), further comprising:

a tray detachably mounted in the apparatus and accommodating the support member; and a first sensor selectively detecting a presence of the tray in the apparatus and an absence of the tray from the apparatus, wherein the controller determines that the support member is located at the feeding position while the first sensor detects the presence of the tray in the apparatus.

In general, where the support member is stored in a tray detachably mounted in an image forming apparatus, a loading of a recording medium into the support member requires a removal of the tray from the image forming apparatus. Therefore, it can be predicted that the support member is located at the feeding position, as long as the tray is held in position within the image forming apparatus.

In view of the above findings, the apparatus according to the above mode (17) determines that the support member is located at the feeding position while the first sensor detects the presence of the tray in the instant apparatus, fostering a correct determination as to whether or not the support member is located at the feeding position.

(18) The apparatus according to any one of modes (14)-(17), further comprising a second sensor detecting a presence of the support member at the feeding position, wherein the controller determines that the support member is located at the feeding position while the second sensor detects the presence of the support member at the feeding position.

The apparatus according to the above mode (18) allows the detection of the support member at the feeding position by means of the second sensor, with the result that a correct determination is made as to whether or not the support member is located at the feeding position, based on the result from the second sensor.

(19) The apparatus according to any one of modes (1)-(18), further comprising a transmission controlling mechanism preventing transmission of the driving force of the first drive source to the drive mechanism, in response to completion of displacement of the support member to the feeding position by the drive mechanism.

The apparatus according to the above mode (19) prevents the driving force of the first drive source from applying to the drive mechanism even after completion of the displacement of the support member to the feeding position, allowing the support member to be stopped accurately at the feeding position.

(20) An apparatus for forming an image on a recording medium, comprising:

a first drive source;

a photoreceptor receiving a driving force of the first drive source;

a support member supporting the recording medium to be fed toward the photoreceptor, displaceable between a receiving position allowing reception of the recording medium by the support member, and a feeding position allowing feeding of the recording medium from the support member toward the photoreceptor;

a drive mechanism operable by a driving force received from the first drive source to displace the support member from the receiving position to the feeding position;

a switch mechanism disposed in a travel path along which the driving force travels from the first drive source to the photoreceptor; and a controller for controlling the switch mechanism to prevent transmission of the driving force from the first drive source to the photoreceptor during at least a predetermined portion of a period during which the drive mechanism displaces the support member from the receiving position to the feeding position.

The apparatus according to the above mode (20) allows the first drive source to displace the support member by a driving force applied from the first drive source, from the receiving position to the feeding position, with the result that the recording medium on the support member is pressed under a substantially constant pressing force onto a feeding element such as a pick-up roller for feeding out the recording medium from the support member toward the photoreceptor. This facilitates improvement in feeding accuracy of the recording medium and reduction in noise during continuous feed of a plurality of recording media.

The apparatus according to the above mode (20) also allows the driving force of the first drive source to apply to both the photoreceptor and the support member, enabling the first drive source to function as a drive source common to both these photoreceptor and support member. This eliminates increase in manufacturing cost.

The apparatus according to the above mode (20) still also allows the photoreceptor not to be driven during at least a predetermined portion of a period allowing the displacement of the support member from the receiving to the feeding position, preventing the degradation of the photoreceptor due to its drive, to a degree depending on the length of the period during which the photoreceptor is not being driven. This is conducive to a prolonged life of the photoreceptor.

(21) The apparatus according to mode (20), further comprising:

a second drive source; and an optical element driven by the second drive source for scanning the photoreceptor with laser light to thereby form an electrostatic latent image on the photoreceptor, wherein the photoreceptor carries thereon a developer image resulting from development of the electrostatic latent image, wherein the developer image is transferred from the photoreceptor to the recording medium delivered to the photoreceptor, at a point of time of transfer established based on a length of a scanning readiness period elapsed from a time at which a driving operation of the second drive source starts to a time at which the driving speed of the second drive source reaches a speed allowing scanning of the photoreceptor with the laser light using the optical element, wherein feed of the recording medium from the support member toward the photoreceptor starts at a start time of feed allowing that the recording medium reaches the photoreceptor by the point of time of transfer, and wherein the controller controls the switch mechanism to allow transmission of the driving force from the first drive source to the photoreceptor prior to the start time of feed within the scanning readiness period.

The apparatus according to the above mode (21) allows the application of the driving force of the first drive source to the photoreceptor to be experienced by the start time of feed of the recording medium from the support member toward the photoreceptor, and allows the feed of the recording medium from the support member to the photoreceptor which is in motion because of the driving force applied from the first drive source to be experienced by the point of time of transfer established by allowing for the scanning readiness period.

For this reason, the apparatus according to the above mode (21), irrespective of the presence of a period during which transmission of the driving force of the first drive source to the photoreceptor is prevented, within the displacement of the support member from the receiving to the feeding position, allows the completion of the transfer of a developer image onto the recording medium, without a delay of the point of time of transfer of the developer image.

(22) The apparatus according to mode (21), wherein a start time at which a driving operation of the second drive source starts and a start time at which a driving operation of the first drive source starts are different from each other.

The apparatus according to the above mode (22), owing to the existence of a difference between the start time at which a driving operation of the second drive source starts and the start time at which a driving operation of the first drive source starts, prevents an increase in instantaneous load on a common power source unit for supplying power to both the first and the second drive source.

The apparatus according to the above mode (22) therefore allows a stabilized power supply of the power source unit to the first and the second drive source, resulting in stabilized operations of the first and the second drive source.

(23) The apparatus according to mode (21) or (22), further comprising:

a transfer device transferring the developer image from the photoreceptor onto the recording medium; and a transfer-bias applicator applying to the transfer device a selected one of a transfer bias and a transfer cleaning bias, wherein the controller applies the transfer cleaning bias to the transfer device via the transfer bias applicator prior to the start time of feed within the scanning readiness period, to thereby complete a cleaning operation for cleaning the transfer device.

The apparatus according to the above mode (23) allows the cleaning of the transfer device to be completed by the start time of feed of the recording medium from the support member toward the photoreceptor. The apparatus therefore allows the application of the transfer bias to the transfer device during feeding of the recording medium from the support member toward the photoreceptor, with a stabilized transfer of the developer image onto the recording medium.

(24) The apparatus according to mode (23), wherein the controller applies the transfer bias to the transfer device via the transfer bias applicator concurrently with or after the start time of feed.

The apparatus according to the above mode (24) prevents an application of the transfer bias to the transfer device prior to the start time of feed of the recording medium from the support member toward the photoreceptor, and therefore prevents a long-time application of the transfer bias to the transfer device, resulting in a prolonged life and improved durability of the transfer device.

(25) The apparatus according to any one of modes (21)-(24), further comprising a cleaner cleaning the photoreceptor by applying a photoreceptor cleaning bias to the photoreceptor, wherein the controller applies the photoreceptor cleaning bias to the photoreceptor via the cleaner prior to the start time of feed within the scanning readiness period.

The apparatus according to the above mode (25) allows the application of the photoreceptor cleaning bias to the cleaner to be initiated prior to the start time of feed of the recording medium from the support member toward the photoreceptor. The apparatus therefore allows the cleaning of the photoreceptor to be completed by a time at which the scanning of the photoreceptor with the laser light is initiated, resulting in a confident formation of an electrostatic latent image on the photoreceptor.

(26) The apparatus according to any one of modes (1)-(25), further comprising:

a tray detachably mounted in the apparatus and accommodating the support member; and a feeding element feeding the recording medium on the support member toward the photoreceptor, wherein the support member is accommodated in the tray and is selectively displaced to the feeding position and the receiving position, wherein the support member is closer at the feeding position to the feeding element than that at the receiving position, and wherein the feeding element is brought into contact with an uppermost one of a plurality of recording sheets each corresponding to the recording medium stacked on the support member.

The apparatus according to the above mode (26) allows reception of recording sheets on the support member, or loading of recording sheets in the tray, with the support member at the receiving position in the form of the lowest position, for example.

The apparatus according to the above mode (26) further allows feeding out of the uppermost one of the recording sheets from the tray, in contact with the feeding element, with the support member at the feeding position.

(27) The apparatus according to mode (26), wherein the feeding element comprises a pick-up roller picking up and feeding out the uppermost recording sheet from the tray because of rotation of the pick-up roller in contact with the uppermost recording sheet.

Several presently preferred embodiments of the invention will be described in detail by reference to the drawings in which like numerals are used to indicate like elements throughout.

FIG. 1 is a side cross-sectional view showing the relevant portion of a laser printer 1 as an image forming apparatus according to an embodiment of the present invention. As shown in FIG. 1, the laser printer 1 includes a body casing 2, a feeder section 4 for feeding a recording sheet 3 of paper as a recording medium, an image forming section 5 for forming an image on the recording sheet 3 of paper which has been fed, etc. The feeder section 4 and the image forming section 5 are disposed within the body casing 2.

On one of the sides apart from each other in the back and forth direction of the body casing 2, there is formed an opening 6 allowing a process cartridge 20 described below to be attached to and detached from the laser printer 1 through the opening 6. On the same side, a front cover 7 is provided for allowing the opening 6 to selectively become open and closed. The front cover 7 is pivotally supported at a cover pivot shaft (not shown) disposed to penetrate the front cover 7 at the lower end portion thereof.

Because of this arrangement, a closing (folding) action of the front cover 7 about the axis of the cover pivot shaft causes the opening 6 to become closed by the front cover 7, while an opening (unfolding) action of the font cover 7 about the axis of the cover pivot shaft causes the opening 6 to become open. In this open state, the attachment and detachment of the process cartridge 20 are selectively achieved through the opening 6.

In the foregoing description of the laser printer 1 and the process cartridge 20 described below in more detail, one side of the body casing 2 on which the front cover 7 is disposed will be referred to as "font side" (i.e., the right-hand side in FIG. 1) and the opposite side as "rear side" (i.e., the left-hand side in FIG. 1), with the process cartridge 20 being attached to the body casing 2.

The feeder section 4, which is disposed at the bottom portion of the body casing 2, includes: a feed tray 9 functioning as a tray, which is detachably mounted in the laser printer 1; a feed roller 10 and a feed pad 11, both of which are disposed over the front end portion of the feed tray 9; a pick-up roller 12 functioning as a feeding element, which is disposed at the rear of the feed roller 10; a pinch roller 13 disposed below the front end portion of the feed roller 10 in opposing relation therewith; a paper-particle or paper-dust collection roller 8 disposed above the front end portion of the feed roller 10 in opposing relation therewith; and a pair of registration rollers 14, 14 disposed at the rear of the feed roller 10 thereover.

The feed tray 9 is selectively attached to and detached from the body casing 2 through the corresponding one of back and forth sliding movements (approximately horizontal movements) of the feed tray 9 relative to the body casing 2.

Within the feed tray 9, there is provided a sheet pressure plate 15 functioning as a support member capable of receiving a stack of recording sheets 3 of paper. The sheet pressure plate 15, because of being pivotally supported at its rear end, is capable of selectively being pivoted into a receiving position at which the sheet pressure plate 15 extends along a bottom plate 16 of the feed tray 9 and at which the front end portion of the sheet pressure plate 15 is disposed downwardly away from the pick-up roller 12, as indicated in solid lines in FIG. 1, and a feeding position at which the sheet pressure plate 15 is pivoted about an axis located at the rear end portion of the sheet pressure plate 15, such that the sheet pressure plate 15 is raised up at its front end portion, and at which the front end portion is in proximity to the pick-up roller 12, as indicated in dash-dot-dot lines in FIG. 1.

At the front end portion of the feed tray 9, a lever 17 functioning as a driving mechanism for raising up the front end portion of the sheet pressure plate 15 is disposed. The lever 17 is generally L-shaped in section, such that the lever 17 extends angularly around the front end portion of the sheet pressure plate 15 from its front to its underside. The upper end of the lever 17 is connected to a lever shaft 18 disposed at the front end portion of the feed tray 9, while the lower end of the lever 17 abuts the front end portion of the sheet pressure plate 15 on a downwardly-facing surface thereof.

Owing to this arrangement, the application of a driving power of a main motor 95 as described below to the lever shaft 18 causes the lever 17 to pivot about the axis of the lever shaft 18 in a clockwise direction in FIG. 1, whereby the lower end portion of the lever 17 lifts up the sheet pressure plate 15 at its front end portion.

The sheet pressure plate 15, upon being raised from the receiving position to the feeding position due to the lifting up of the sheet pressure plate 15 at the front end portion, presses the uppermost recording sheet 3 of paper stacked on the sheet pressure plate 15 against the pick-up roller 12. In the feeding position of the sheet pressure plate 15, the uppermost recording sheet 3 of paper stacked on the sheet pressure plate 15 is picked up via the pick-up roller 12 because of its rotation due to reception of a rotational driving force from the main motor 95 as described below, and then is fed toward between the feed roller 10 and the feed pad 11.

The sheet pressure plate 15, upon the feed tray 9 being detached from the body casing 2, is lowered due to gravity at its front end portion downwardly away from the pick-up roller 12 to the receiving position, at which the sheet pressure plate 15 extends along the bottom plate 16 of the feed tray 9. The receiving position of the sheet pressure plate 15 permits loading of a stack of recording sheets 3 of paper onto the sheet pressure plate 15.

The uppermost recording sheet 3 of paper is fed by means of the pick-up roller 12 toward between the feed roller 10 and the feed pad 11, and is then interposed therebetween. The uppermost recording sheet 3, as being interposed between the feed roller 10 and the feed pad 11, is fed positively in the form of a single separated sheet due to the rotation of the feed roller 10 resulting from a rotational driving power of the main motor 95 as described below in more detail. The fed recording sheet 3 of paper, after passing between the feed roller 10 and the pinch roller 13, reaches the paper-particle collection roller 8 driven by the feed roller 10 for paper particles residing on the recording sheet 3 of paper to be removed therefrom, and then is delivered to the registration rollers 14,14.

The registration rollers 14, 14 in the form of a pair of opposing rollers are configured to deliver the recording sheet 3 of paper, after registration thereof, into a transfer position which is located between a photosensitive drum 29 and a transfer roller 32 both described below, and at which a toner image on the photosensitive drum 29 is transferred onto the recording sheet 3 of paper.

A registration sensor 106 is so provided for detecting a passing of a recording sheet 3 of paper as to be disposed downstream from the feed roller 10 and upstream from the registration rollers 14,14 in the travel direction of the recording sheet 3 of paper. The registration sensor 106 which is pivotally mounted on the body casing 2, in operation, pivots in response to a passing of a recording sheet 3 of paper, to thereby detect the passing of the recording sheet 3 of paper. The registration sensor 106 outputs an on-state-signal during passing of a recording sheet 3 of paper, while outputs an off-state-signal otherwise.

The image forming section 5 includes a scanning device 19, the process cartridge 20, a fusing device 21, etc.

The scanning device 19 disposed at the upper portion of the body casing 2 includes: a laser light source (not shown); a scanner motor 108 functioning as a second drive source; a polygon mirror 22 functioning as an optical element; an f θ lens 23; a reflective mirror 24; a lens 25; a reflective mirror 26; etc.

A laser beam emitted from the aforementioned laser light source based on image data travels as illustrated in broken lines in FIG. 1, such that the laser beam is deflected at the polygon mirror 22 driven for rotation by the scanner motor 108, is passed through the f θ lens 23, and then enters the reflective mirror 24 with the optical path of the laser beam being bent. The laser beam is in turn passed through the lens 25 and then enters the reflective mirror 26 with the optical path of the laser beam being bent, to thereby illuminate a surface of the photosensitive drum 29 within the process cartridge 20, which the photosensitive drum 29 will be described below in more detail.

The process cartridge 20 is detachably mounted in the body casing 2 under the scanning device 19. The process cartridge 20 includes an upper frame 27, and a lower frame 28 which is formed separately from the upper frame 27 and which is united with the upper frame 27 in use. The process cartridge 20 includes within a body casing constructed by uniting the upper frame 27 with the lower frame 28: the photosensitive drum 29 functioning as a photoreceptor; a scorotron-type charger 30; a developer cartridge 31; a transfer roller 32 functioning as a transfer device; and a cleaning brush 33 functioning as a cleaner.

The photosensitive drum 29 includes a cylindrical drum body 34 and a metal drum shaft 35 located at the center of the drum body 34. The drum body 34 is constructed such that the outermost surface thereof is covered with a positively charged photosensitive layer made of material such as polycarbonate. The drum shaft 35 extends along the longitudinal direction of the drum body 34. The drum shaft 35 is supported at the upper frame 27, and the drum body 34 is rotatably supported at the drum shaft 35, thereby allowing the photosensitive drum 29 to be rotatable at the upper frame 27 about the axis of the drum shaft 35. The photosensitive drum 29 is driven for rotation due to a driving force received from the main motor 95 (see FIG. 7).

The scorotron-type charger 30, as supported at the upper frame 27, is disposed behind and above the photosensitive drum 29 a predetermined distance apart therefrom in non-contact and opposing relationship thereto. The scorotron-type charger 30 includes a discharge wire 37 and a grid 38. The discharge wire 37 is disposed so as to extend along the axial direction of the photosensitive drum 29, and so as to be opposed to the photosensitive drum 29 a predetermined distance apart therefrom. The grid 38 is disposed between the discharge wire 37 and the photoconductive drum 29 to control the amount of discharge from the discharge wire 37 to the photosensitive drum 29.

The scorotorn-type charger 30 permits the application of a high voltage to the discharge wire 37 concurrently with the application of a bias voltage to the grid 38, to thereby introduce a corona discharge at the discharge wire 37, resulting in the surface of the photosensitive drum 29 being uniformly and positively charged.

The scorotron-type charger 30 includes a cleaning member 36 for cleaning the discharge wire 37 with the cleaning member 36 holding the discharge wire 37 in pressure contact therewith.

The developer cartridge 31 is detachably mounted in the lower frame 28. The developer cartridge 31 includes therein a toner storage 39 functioning as a storage device, a supply roller 40, a developer roller 41, and a thickness-regulating blade 42.

The toner storage 39 is formed at a front one of inner sub-spaces into which the inner entire space within the developer cartridge 31 is partitioned by a partition plate 43. The toner storage 39 is filled with a positively charged and non-magnetic mono-component toner functioning as a developer material.

The toner is a polymeric toner produced by copolymerization such as suspension polymerization of polymerizable monomers, such as styrene-based monomers (e.g., styrenes) or acrylic-based monomers (e.g., acrylic acids, alkyl (between C1-C4) acrylates, or alkyl (between C1-C4) methacrylates). Such a polymeric toner is composed of particles approximately spherical in shape and is outperforming in fluidity, thereby enhancing an image formation in quality.

A colorant (e.g., carbon black), wax, etc., are blended with the toner, and an external additive such as silica is further added for improving the toner in fluidity. The average particle-size of the toner is between approximately 6 μm to approximately 10 μm.

An agitator 44 is disposed within the toner storage 39. Upon agitated by the agitator 44, the toner is delivered from the toner storage 39 toward the supply roller 40 through an aperture 45 which is formed under the partition plate 43, and which allows communication between the front and rear sub-spaces within the developer cartridge 31.

The supply roller 40, as disposed on the rear side of the aperture 45, is rotatably supported at the developer cartridge 31. The supply roller 40 is constructed by covering a metal roller shaft with a roller element made up of an electro-conductive foam material. The supply roller 40 is driven for rotation because of a driving force received from the main motor 95 (see FIG. 7).

The developer roller 41, as disposed behind the supply roller 40 in compressing and contacting engagement therewith, is rotatably supported at the developer cartridge 31. With the developer cartridge 31 being mounted in the lower frame 28, the developer roller 41 is in contacting and opposing relationship to the photosensitive drum 29. The developer roller 41 is constructed by covering a metal roller shaft with a roller element made up of an electro-conductive rubber material. The roller element of the developer roller 41 is constructed by coating the surface of a roller body made up of an electro-conductive urethane rubber or silicone rubber including carbon particles, etc., with a coating layer made up of urethane rubber or silicone rubber including fluorine. In development operation, a development bias is applied to the developer roller 41. The developer roller 41 is driven for rotation in the same direction as the rotation of the supply roller 40 because of a driving force received from the main motor 95 (see FIG. 7).

The thickness-regulating blade 42 includes a blade body 46 made up of a metal plate-like spring member, and a pressing member 47 disposed at the tip of the blade body 46. The pressing member 47 as made up of an insulating silicone rubber is generally semicircular in section. The thickness-regulating blade 42 is supported at the developer cartridge 31 above the developer roller 41. The pressing member 47 is placed in pressure contact with the developer roller 41 by an elastic force of the blade body 46.

The toner, upon leaving the toner storage 39 through the aperture 45, is supplied to the developer roller 41 because of the rotation of the supply roller 40, and is then positively charged by friction between the supply roller 40 and the developer roller 41. The toner, upon supplied to the developer roller 41, enters between the pressing member 47 of the thickness-regulating blade 42 and the developer roller 41 because of the rotation of the developer roller 41, and is then carried on the developer roller 41 to form a thin layer having a uniform thickness.

The transfer roller 32, as rotatably supported at the lower frame 28, is disposed in contacting and opposing relationship to the photosensitive drum 29 in the vertical direction, to thereby form a nip between the transfer roller 32 and the photosensitive drum 29. The transfer roller 32 is constructed by covering a metal roller shaft with a roller element made up of an electro-conductive rubber material.

The bias to the transfer roller 32 is controlled by a CPU 103 described below, such that, in a transferring operation described below, a regular transfer bias which is set to be lower than the surface potential of the photosensitive drum 29 is applied to the transfer roller 32, while, in a transferring-cleaning operation, a reverse transfer bias which is set to be higher than the surface potential of the photosensitive drum 29 is applied to the transfer roller 32. The transfer roller 32 is driven for rotation in the opposite direction as the rotation of the photosensitive drum 29 because of a driving force received from the main motor 95 (see FIG. 7).

The cleaning brush 33, as mounted in the lower frame 28, is disposed behind the photosensitive drum 29 in contacting and opposing relationship thereto. In drum-cleaning operation, a cleaning bias is applied to the cleaning brush 33 by direction of the CPU 103 described below.

As the photosensitive drum 29 rotates, the surface of the photosensitive drum 29 firstly undergoes the uniform and positive charge by means of the scorotron-type charger 30, and is subsequently exposed to a laser beam emitted from the scanning device 19 through the scanning of the photosensitive drum 29 at a higher speed, to thereby form an electrostatic latent image on the surface of the photosensitive drum 29 corresponding to an image desired to be formed on a recording sheet 3.

Then, the toner which has been positively charged and carried on the developer roller 41 is delivered to an electrostatic latent image which has been formed on the surface of the photosensitive drum 29, with the toner being in contacting and opposing relationship to the photosensitive drum 29, during and because of the rotation of the developer roller 41. The electrostatic latent image corresponds to an exposed area of the surface of the photosensitive drum 29 which has been locally exposed to the laser beam with its potential being locally reduced accordingly, despite that the surface of the photosensitive drum 29 was initially uniformly and positively charged throughout.

As a result of the delivery of the toner, the electrostatic latent image on the photosensitive drum 29 is visualized and a toner image is formed on the surface of the photosensitive drum 29 through the reverse development.

Subsequently, the toner image which has been carried on the surface of the photosensitive drum 29 is transferred onto a recording sheet 3 of paper, because of the regular transfer bias applied to the transfer roller 32, while the recording sheet 3 of paper which is being fed by means of the registration rollers 14, 14 is passed through a transfer position located between the photosensitive drum 29 and the transfer roller 32. The recording sheet 3 of paper, upon receiving the toner image, is delivered to the fusing device 21.

The developer roller 41 collects the residual toner remaining on the photosensitive drum 29 still after transfer of the toner image without transferring onto the recording sheet 3 of paper. The cleaning brush 33, upon a cleaning bias being applied thereto, collects the paper particles attached, after transfer, from the recording sheet 3 of paper to the photosensitive drum 29.

The fusing device 21, as disposed behind the process cartridge 20, includes a fuser frame 48, a heat roller 49, and a pressure roller 50 therein.

The heat roller 49 includes a metal tube and a halogen lamp within the metal tube for heating. The heat roller 49 is driven for rotation by a driving force received from the main motor 95 (see FIG. 7).

The pressure roller 50 is disposed below the heat roller 49 in pressure contact with and in opposing relation to the heat roller 49. The pressure roller 50 as constructed by covering a metal roller shaft with a roller element made up of a rubber material is rotated to follow up the rotation of the heat roller 49.

The fusing device 21, in operation, heat fuses the toner transferred onto the recording sheet 3 of paper at the transfer position, onto the recording sheet 3 of paper during a passing thereof through between the heat roller 49 and the pressure roller 50. The recording sheet 3 of paper, upon the toner being fused thereto, is delivered to an exit path 51 which extends toward the top surface of the body casing 2 in the vertical direction.

The recording sheet 3, upon delivery to the exit path 51, is ejected from the body casing 2 by means of an exit roller 52 disposed on the downstream side of the exit path 51, into an exit tray 54 formed on the upper surface of the body casing 2.

Figure 2:
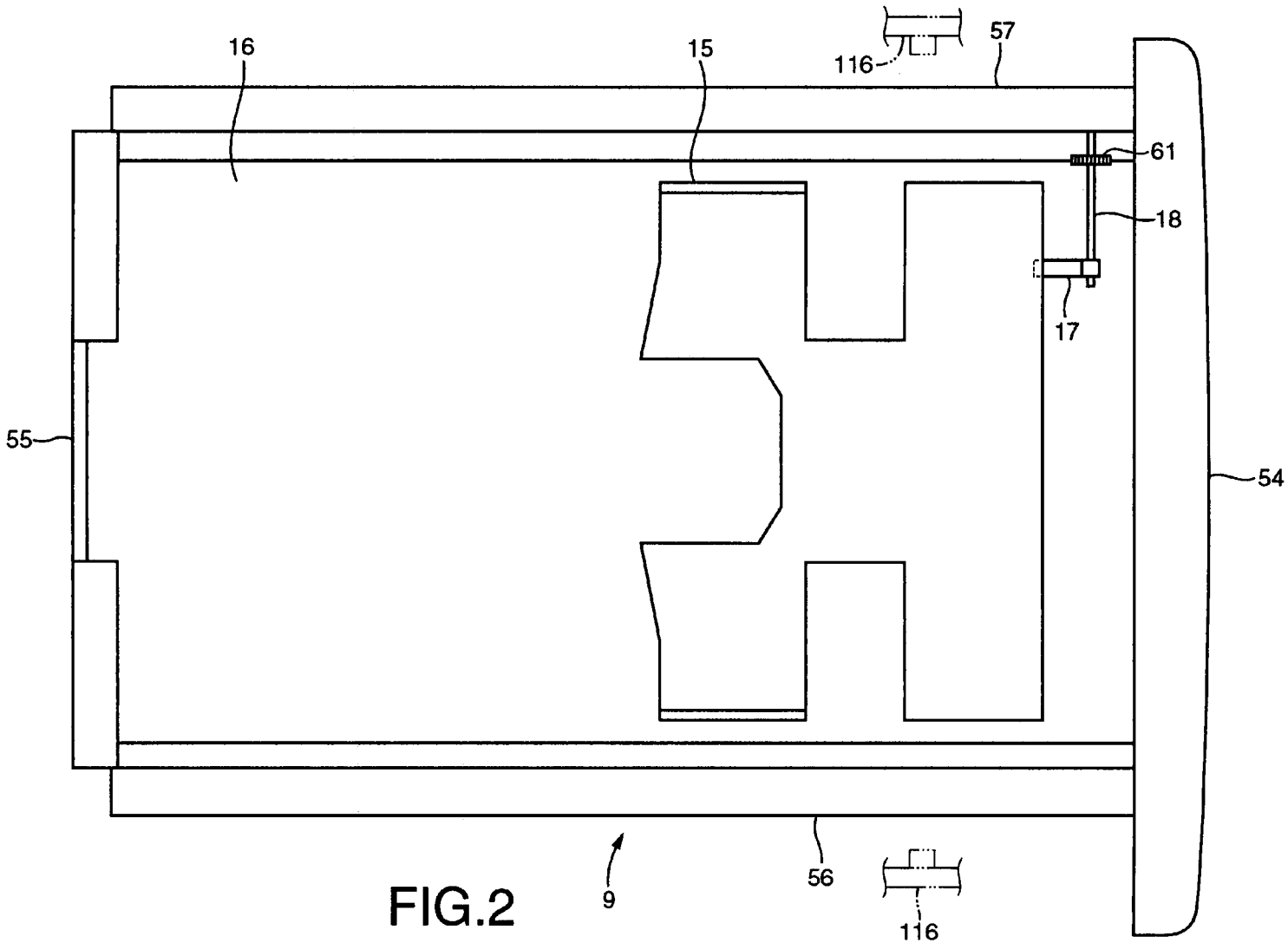
FIG. 2 is a top view illustrating a feed tray of the laser printer shown in FIG. 1.

FIG. 2 is a top view showing the feed tray 9. The feed tray 9 is integrally formed to include: a front wall 54 extending upright at the front end of the bottom plate 16; a back wall 55 extending upright at the rear end of the bottom plate 16; and a pair of side walls 56, 57 both extending upright at the both lateral end portions of the bottom plate 16, respectively. The both lateral end portions are apart from each other in a direction perpendicular to a direction in which the front wall 54 and the rear wall 55 are apart from each other.

A grip (not shown) is formed at the front wall 54 for enabling the user to grip the feed tray 9 for attachment and detachment thereof through the front portion of the body casing 2 relative to the body casing 2.

In the foregoing description, a direction perpendicular to the back and forth direction of the feed tray 9 will be referred to as "widthwise direction." One of both sides opposing to in the widthwise direction will be referred to as "right side" (i.e., the top side of FIG. 2) while the other will be referred to as "left side" (i.e., the bottom side of FIG. 2).

The front wall 54, the back wall 55, the left-side wall 56, and the right-side wall 57 each extend perpendicularly to the bottom plate 16 to form a space rectangular as viewed in top view over the bottom plate 16, with the space being surrounded by the front, back, left-side, and right-side walls 54, 55, 56, 57. Within the surrounded space, the sheet pressure plate 15, the lever 17, the lever shaft 18, and a lever drive gear 61 are provided. The lever 17, the lever shaft 18, and the lever drive gear 61 are disposed at the right front of the sheet pressure plate 15.

The lever shaft 18 is rotatably supported by a bearing (not shown), which is mounted on the right-side wall 57. The lever shaft 18 as positioned in front of the sheet pressure plate 15 extends along the widthwise direction up to a position at which the left end of the lever shaft 18 is opposed to the right front portion of the sheet pressure plate 15. The lever 17 is mounted on the lever shaft 18 at the left end thereof in an anti-rotation manner relative to the lever shaft 18.

The lever shaft 18 is inserted into the center of the lever drive gear 61 which is mounted on the right end of the lever shaft 18 in an anti-rotation manner relative to the lever shaft 18. With the feed tray 9 being attached to the body casing 2, the lever drive gear 61 is disposed below a transmission gear 79 of a feed drive section 58 described below in opposing relationship to and meshing engagement with the transmission gear 79.

Figure 3:
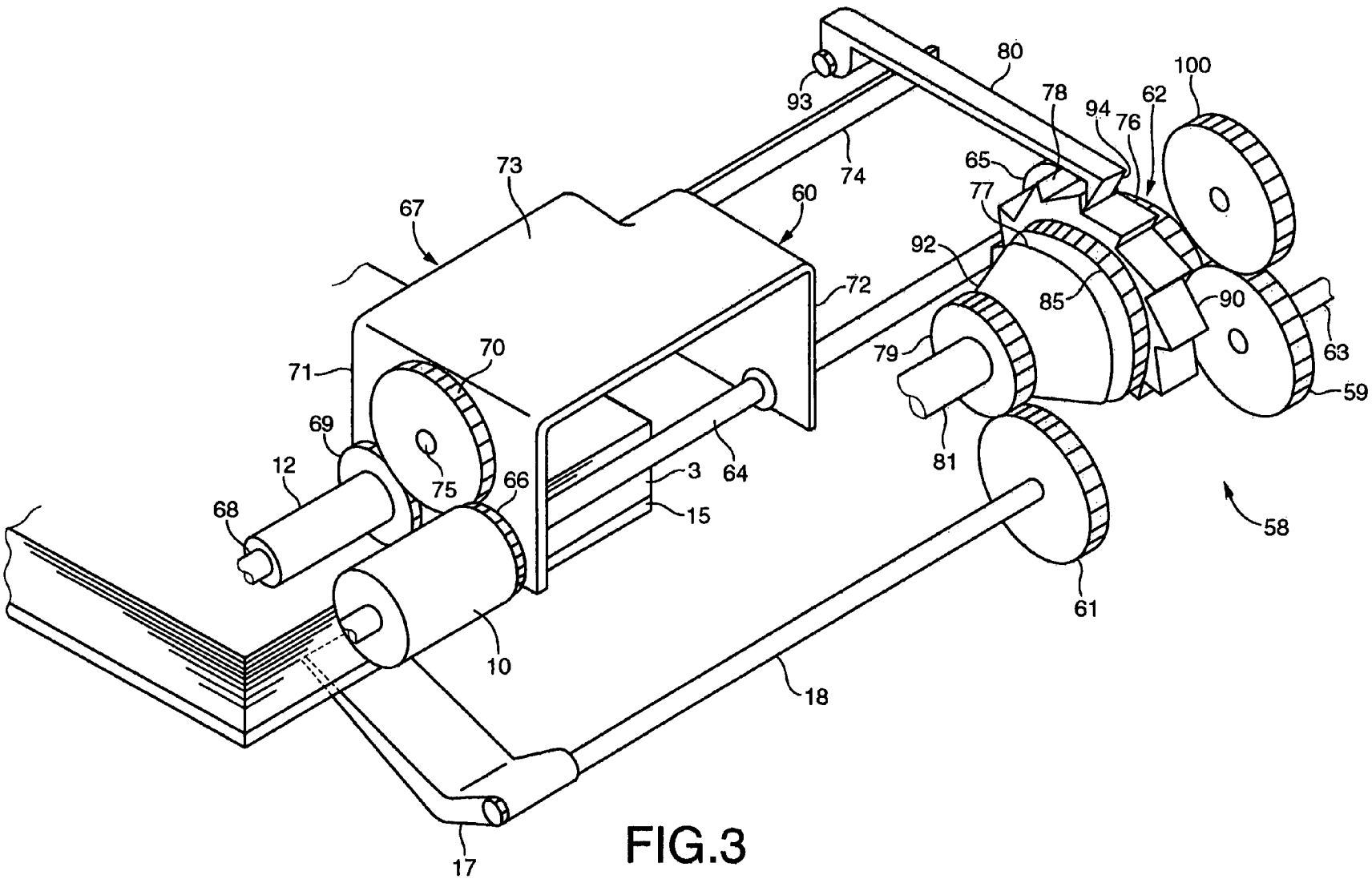
FIG. 3 is a perspective view illustrating a feed drive section and its peripherals provided to a body casing of the laser printer shown in FIG. 1.

As shown in FIG. 3, the feed drive section 58 as disposed in the body casing 2 includes: an input gear 59 to which a rotational driving force is imparted from the main motor 95 (see FIG. 7) via an output gear 100, both of which will be described below in more detail; a roller drive mechanism 60 for rotating the feed roller 10 and the pick-up roller 12; and a drive transmission mechanism 62 functioning as a transmission controlling mechanism that transmits the rotational driving force applied to the input gear 59 to the roller drive mechanism 60 and the lever drive gear 61 where necessary.

An input gear shaft 63, as rotatably supported at the body casing 2 while extending in the widthwise direction, is inserted into the center of the input gear 59 which is mounted on the input gear shaft 63 in an anti-rotation manner relative to the input gear shaft 63. Once the output gear 100 is rotated because of a rotational driving force received from the main motor 95, the input gear 59 is caused to rotate in the opposite direction to the output gear 100 because of a rotational driving force received from the output gear 100.

The roller drive mechanism 60 includes: a feed roller shaft 64; a feed-roller drive gear 65; a drive output gear 66; an oscillating box 67; a pick-up roller shaft 68; a pick-up roller drive gear 69; and an intermediate gear 70.

The feed roller shaft 64 as rotatably supported at the body casing 2 above the right front end portion of the feed tray 9 extends along the widthwise direction, with the feed tray 9 being attached to the body casing 2. The feed roller 10 is mounted on the feed roller shaft 64 at the left end thereof in an anti-rotation manner relative thereto.

Figure 4:
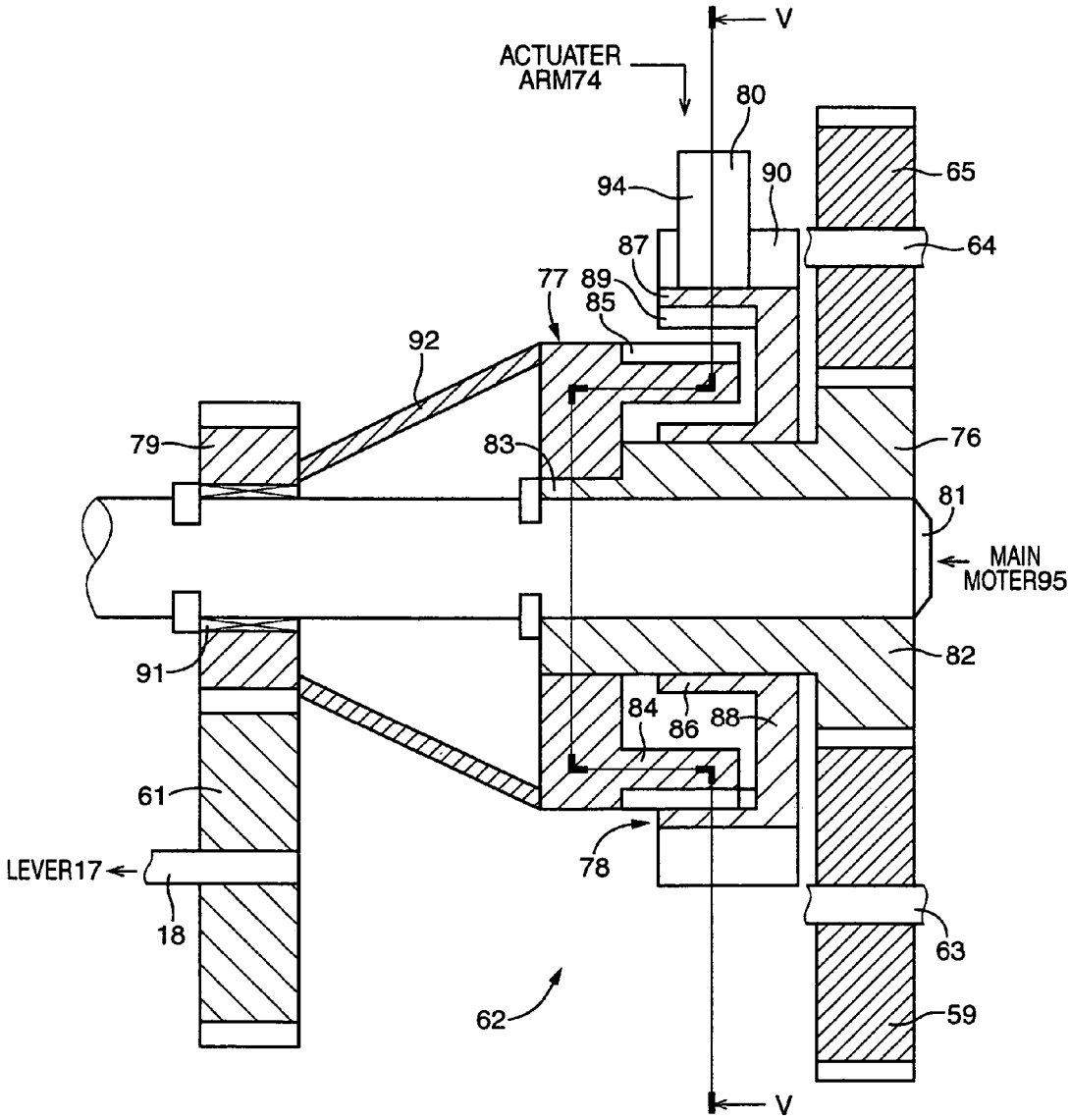
FIG. 4 is a sectional view illustrating a drive transmission mechanism shown in FIG. 3.

As shown in FIG. 4, the right end of the feed roller shaft 64 is inserted into the center of the feed-roller drive gear 65 which is mounted on the feed roller shaft 64 in an anti-rotation manner relative thereto. The feed roller drive gear 65 meshes with a feed drive transmission gear 76 described below. Rotation of the feed drive transmission gear 76 causes the feed roller drive gear 65 to rotate in the opposite direction to the feed drive transmission gear 76. A feeder clutch 111 (see FIG. 7) is built-in the feed roller drive gear 65 which is in the form of an electromagnetic clutch for switching a transmission/non-transmission of a rotational driving force applied from the feed drive transmission gear 76 to the feed roller shaft 64.

As shown in FIG. 3, the feed roller shaft 64 is inserted into the center of the drive output gear 66 which is disposed adjacent to the feed roller 10 on the right side thereof and is mounted on the feed roller shaft 64 in an anti-rotation manner relative thereto.

The oscillating box 67, as disposed between the feed-roller drive gear 65 and the drive output gear 66, includes: a left-side plate 71 and a right-side plate 72 which are a predetermined distance apart from each other in the widthwise direction in opposing relationship to each other; and an upper plate 73 which connects the left-side plate 71 and the right-side plate 72 at the respective top end portions. The oscillating box 67, as supported by the feed roller shaft 64 pivotally about its axis, is constructed such that the feed roller shaft 64 is inserted into the left-side plate 71 and the right-side plate 72 at the respective lower front ends. An actuator arm 74, which is provided for actuating a stop arm 80 described below, is supported at the right-side plate 72 while extending rightward from the right-side plate 72.

The pick-up roller shaft 68, as rotatably supported at the lower rear end portion of the left-side plate 71, extends leftward from the left-side plate 71 in parallel to the feed roller shaft 64. The pick-up roller 12 is mounted on the pick-up roller shaft 68 at the left end thereof in an anti-rotation manner relative thereto.

The pick-up roller shaft 68 is inserted into the center of the pick-up roller drive gear 69 which is mounted on the pick-up roller shaft 68 in an anti-rotation manner relative thereto, and which is disposed between the pick-up roller 12 and the left-side plate 71 of the oscillating box 67. The pick-up roller drive gear 69 is identical in diameter to the drive output gear 66, and has gear teeth on its own outer circumferential surface identical in number of teeth to the drive output gear 66.

A gear shaft 75, as rotatably supported at the left-side plate 71 of the oscillating box 67 while extending in the widthwise direction of the oscillating box 67, is inserted into the intermediate gear 70 which is mounted on the gear shaft 75 in an anti-rotation manner relative thereto. The intermediate gear 70 meshes with the drive output gear 66 and the pick-up roller drive gear 69, respectively.

Because of this arrangement, once the feed roller drive gear 65 is rotated with the feeder clutch 111 placed in a connecting state (i.e., a state allowing the transmission of a rotational driving force to the feed roller shaft 64), the rotation of the feed roller shaft 65 is caused with the rotations of the feed roller 10 and the drive output gear 66 in the same direction as the feed roller drive gear 65.

The rotational driving force of the drive output gear 66 is transmitted to the intermediate gear 70, resulting in the rotation of the intermediate gear 70 in the opposite direction to the drive output gear 66. Further, the rotational driving force of the intermediate gear 70 is transmitted to the pick-up roller drive gear 69, resulting in the rotation of the pick-up roller drive gear 69 in the opposite direction to the intermediate gear 70. As a result, the pick-up roller 12 is rotated in the same direction as the pick-up roller drive gear 69, which is the same direction as the feed roller 10.

As shown in FIGS. 3 and 4, the drive transmission mechanism 62 includes the feed drive transmission gear 76, an oscillating gear 77, an internal gear 78, the transmission gear 79, and the stop arm 80.

The feed drive transmission gear 76 is mounted on a laterally extending rotary shaft 81 in an anti-rotation manner relative thereto. The feed drive transmission gear 76 is disposed between the input gear 59 and the feed roller drive gear 65 in mesh therewith, respectively. As shown in FIG. 4, the feed drive transmission gear 76 is integrally formed to include a cylindrical portion 82 which is externally fitted onto the rotary shaft 81, and an eccentric cam portion 83 which is eccentric to the rotary shaft 81 and which is disposed on the left-side of the cylindrical portion 82. A plurality of external gear teeth in mesh with both the input gear 59 and the feed roller drive gear 65 are formed at the right end of the cylindrical portion 82. The rotary shaft 81 is rotatably supported by a bearing (not shown) within the body casing 2.

The oscillating gear 77 is externally and rotatably fitted onto the eccentric cam portion 83 of the feed drive transmission gear 76. The oscillating gear 77 integrally includes a cylindrical gear portion 84 which is formed around the circumference of the cylindrical portion 82 of the feed drive transmission gear 76. A plurality of external gear teeth 85 are formed at the outer circumference of the gear portion 84.

The internal gear 78 is integrally formed to include: a cylindrical receiving portion 86 into which the cylindrical portion 82 of the sheet drive transmission gear 76 is rotatably inserted; and a cylindrical gear portion 87 which is formed around the circumference of the receiving portion 86; and an annular plate-like connecting portion 88 which connects the receiving portion 86 and the gear portion 87 at the respective right ends thereof. The receiving portion 86 and the gear portion 87 are a predetermined distance apart from each other in the radial direction of the rotary shaft 81.

The oscillating gear 77 is axially projected with the gear portion 84 interposed between the receiving portion 86 and the gear portion 87.

A plurality of internal gear teeth 89 in mesh with the external gear teeth 85 of the gear portion 84 of the oscillating gear 77 are formed at the inner circumference of the gear portion 87. The number of the internal gear teeth 89 is a little larger than that of the external gear teeth 85. At the outer circumference of the gear portion 87, a plurality of ratchet-tooth-like engaged portions 90 are provided for selectively enabling an engagement with and a disengagement from the stop arm 80.

The transmission gear 79 is externally fitted onto the rotary shaft 81 via a one-way clutch 91 at a position a predetermined distance leftward apart from the oscillating gear 77, with the transmission gear 79 in mesh with the lever drive gear 61. The one-way clutch 91 permits a relative rotation of the transmission gear 79 to the rotary shaft 81 in the direction allowing the sheet pressure plate 15 to be lowered, while prevents a relative rotation of the transmission gear 79 to the rotary shaft 81 in the direction allowing the sheet pressure plate 15 to be raised. The transmission gear 79 is connected with the oscillating gear 77 via a generally conical elastic member (as a deformable member) 92 which is disposed around the rotary shaft 81.

As shown in FIG. 3, the stop arm 80 is rotatably supported at its rear end by a supporting shaft 93 laterally extending on the rear side of the actuator arm 74. The stop arm 80 extends in the back and forth direction of the feed tray 9 above the actuator arm 74 and the internal gear 78. At the tip of the stop arm 80, a pawl 94 is formed capable of selectively engaging with the engaged portions 90 of the internal gear 78. The stop arm 80 is elastically forced by a return spring, e.g., a torsion spring in the direction allowing the pawl 94 to engage with the engaged portions 90 of the internal gear 78.

Figure 5:
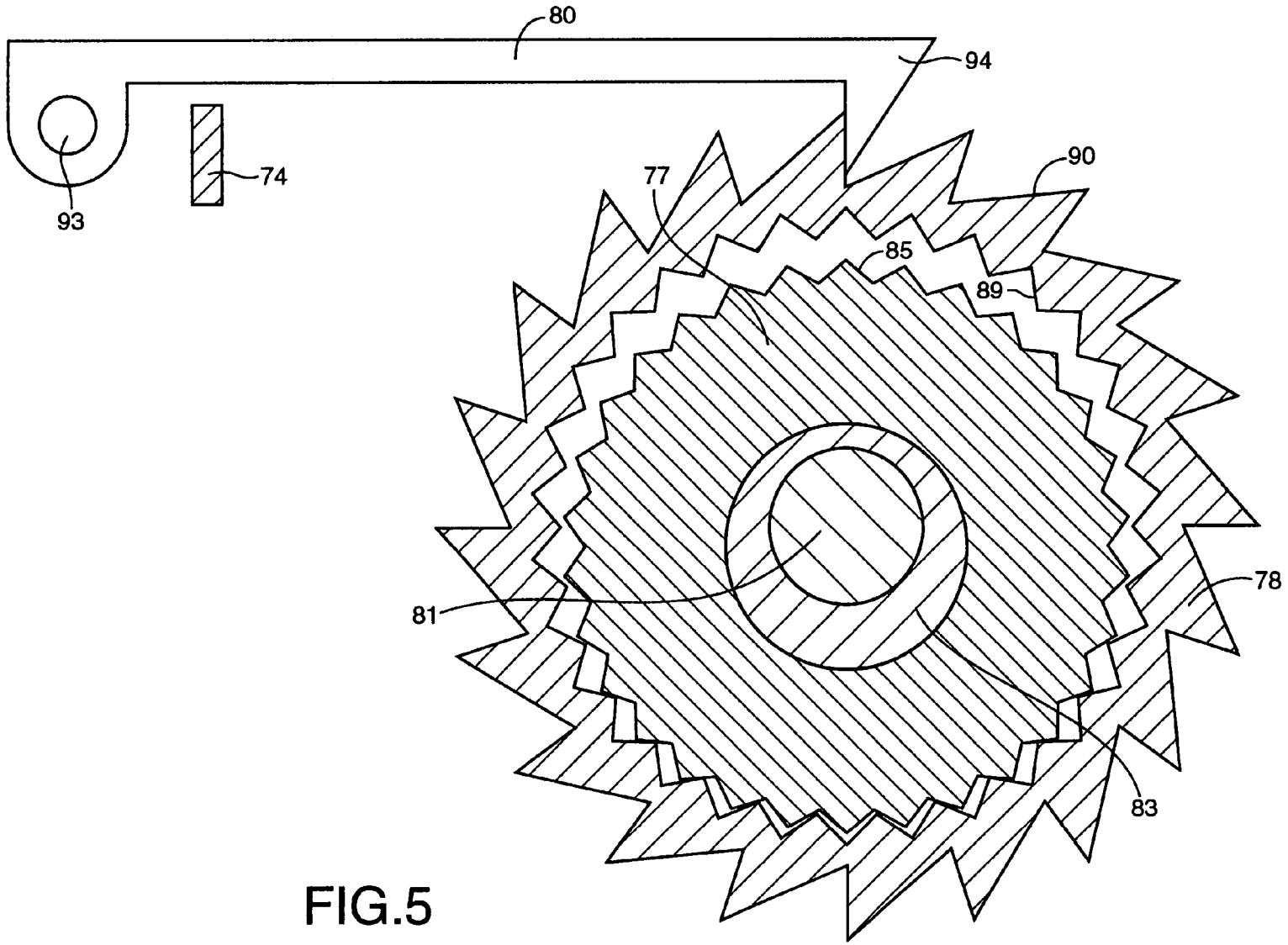
FIG. 5 is a sectional view illustrating an internal gear and a pawl of a stop arm, all of which are shown in FIG. 3, with the pawl stopping the internal gear to rotate.

In a state with the sheet pressure plate 15 positioned at its receiving position, the oscillating box 67 is downward-inclined at the rear side thereof about the axis of the feed roller shaft 64. The actuator arm 74 is disposed downwardly away from the stop arm 80. As shown in FIG. 5, the pawl 94 of the stop arm 80 in engagement with the engaged portions 90 of the internal gear 78 stops the internal gear 78 to rotate.

In this state, a rotational driving force, upon being applied to the input gear 59, is transmitted to the feed drive transmission gear 76, resulting in its rotation in the direction opposite to the input gear 59.

The rotation of the feed drive transmission gear 76 causes the integral rotation of the oscillating gear 77 with that of the feed drive transmission gear 76. In this state, the oscillating gear 77 rolls on and along the inner circumferential surface of the internal gear 78 with the external gear teeth 85 in mesh with the internal gear teeth 89 of the internal gear 78, due to the internal gear 78 being stopped to rotate by the pawl 94 of the stop arm 80.

As the internal gear 78 rolls, the transmission gear 79, which is connected with the oscillating gear 77 via the elastic member 92, rotates about the rotary shaft 81 at a rotation speed which is reduced at a ratio depending upon the difference in tooth number between the internal gear teeth 89 of the internal gear 78 and the external gear teeth 85 of the oscillating gear 77.

As shown in FIG. 3, the rotation of the transmission gear 79 causes the rotation of the lever drive gear 61 in mesh with the transmission gear 79 in the opposite direction to the transmission gear 79, and further causes the integral rotations of the lever shaft 18 and the lever drive gear 61. As a result, the lever 17 mounted on the lever shaft 18 is pivoted so as to rise up at the rear end (free end) thereof, resulting in the rising up of the sheet pressure plate 15 at the front end thereof toward the pick-up roller 12.

A rising up of the sheet pressure plate 15 at its front end causes a recording sheet 3 of paper on the sheet pressure plate 15 to be brought into contact with the pick-up roller 12. A subsequent and additional rising up of the sheet pressure plate 15 at its front end because of the lever 17 causes the recording sheet 3 of paper to push the pick-up roller 12 upwardly.

As a result, the oscillating box 67 is pivoted about the axis of the feed roller shaft 64 in the direction allowing the oscillating box 67 to rise up at its rear end. The pivotal movement of the oscillating box 67 causes the actuator arm 74 to rise up into contact with the stop arm 80 at its downwardly-facing bottom surface.

A still additional rising up of the sheet pressure plate 15 at its front end causes the actuator arm 74 to be pivoted about the axis of the supporting shaft 93 in the direction allowing the pawl 94 to rise up. As a result, the pawl 94 is disengaged from the engaged portions 90 of the internal gear 78, whereby the internal gear 78 becomes free to rotate.

Referring now to FIGS. 4 and 5, where the internal gear 78 is free to rotate, no rotational and circumferential force acts between the internal gear 78 and the oscillating gear 77 having the external gear teeth 85. As a result, even a rotational movement of the eccentric cam portion 83 of the feed drive transmission gear 76 causes the oscillating gear 77 not to rotate about its axis but to be only oscillated perpendicular to the axis of the feed drive transmission gear 76.

As described above, the oscillating gear 77 and the transmission gear 79 are coupled with each other via the elastic member 92 in a manner allowing a limited relative movement between the oscillating gear 77 and the transmission gear 79. Therefore, the oscillating movement of the oscillating gear 77 is absorbed by the elastic member 92, to thereby interrupt a transfer of a rotational force from the oscillating gear 77 to the transmission gear 79, resulting in interruption of a rotation of the transmission gear 79.

Thus, the interruption of a rotation of the oscillating gear 77 introduces the interruption of a rotation of the transmission gear 79, and in turn introduces an interruption of rotations of the lever drive gear 61 and the lever shaft 18.

As a result, as shown in FIG. 3, a pivotal movement of the lever 17 in the direction allowing the lever 17 to be further raised up at its rear end (free end) is prevented, and in turn, a further lifting up operation of the sheet pressure plate 15 by the lever 17 is prevented. Therefore, the sheet pressure plate 15 is caused to be stopped at the feeding position, which allows the uppermost recording sheet 3 on the sheet pressure plate 15 to be brought into contact with the pick-up roller 12.

Upon full displacement of the sheet pressure plate 15 to the feeding position, the above mechanism prevents an additional driving force to apply to the lever 17, enabling an accurate stopping of the sheet pressure plate 15 at the feeding position.

The rotational driving force, once being applied to the input gear 59, is transferred to the feed roller shaft 64 via both the feed drive transmission gear 76 and the feed roller drive gear 65, with the feeder clutch 111 engaged. This provides rotations of the feed roller 10 and the pick-up roller 12, allowing the uppermost recording sheet 3 of paper on the sheet pressure plate 15 to be picked up and fed out from the feed tray 9 by virtue of the pick-up roller 12.

With a decrease in number of the recording sheets 3 of paper stacked on the sheet pressure plate 15, the vertical position of the uppermost recording sheet 3 becomes lowered in height from its feeding position, introducing a pivotal movement of the oscillating box 67 about the axis of the feed roller shaft 64 in the direction allowing the sheet pressure plate 15 to be lowered at its rear end.

Once the above rotation of the oscillating box 67 lowers the actuator arm 74 to a given position, the pawl 94 of the stop arm 80 is brought into engagement with the engaged portions 90 of the internal gear 78, to thereby interrupt the rotation of the internal gear 78 again. As a result, the rotational driving force, upon being applied to the input gear 59, is transferred to the lever drive gear 61 via the oscillating gear 77, to thereby cause the lever 17 to raise the sheet pressure plate 15 to the feeding position.

The above mechanism allows the sheet pressure plate 15 to be held at the feeding position, irrespective of the number, i.e., the total thickness of the recording sheets 3 of paper which are stacked on the sheet pressure plate 15, and therefore allows the recording sheets 3 of paper stacked on the sheet pressure plate 15 to be pressed onto the pick-up roller 12, with an approximately constant pressing force acting therebetween.

Figure 6:
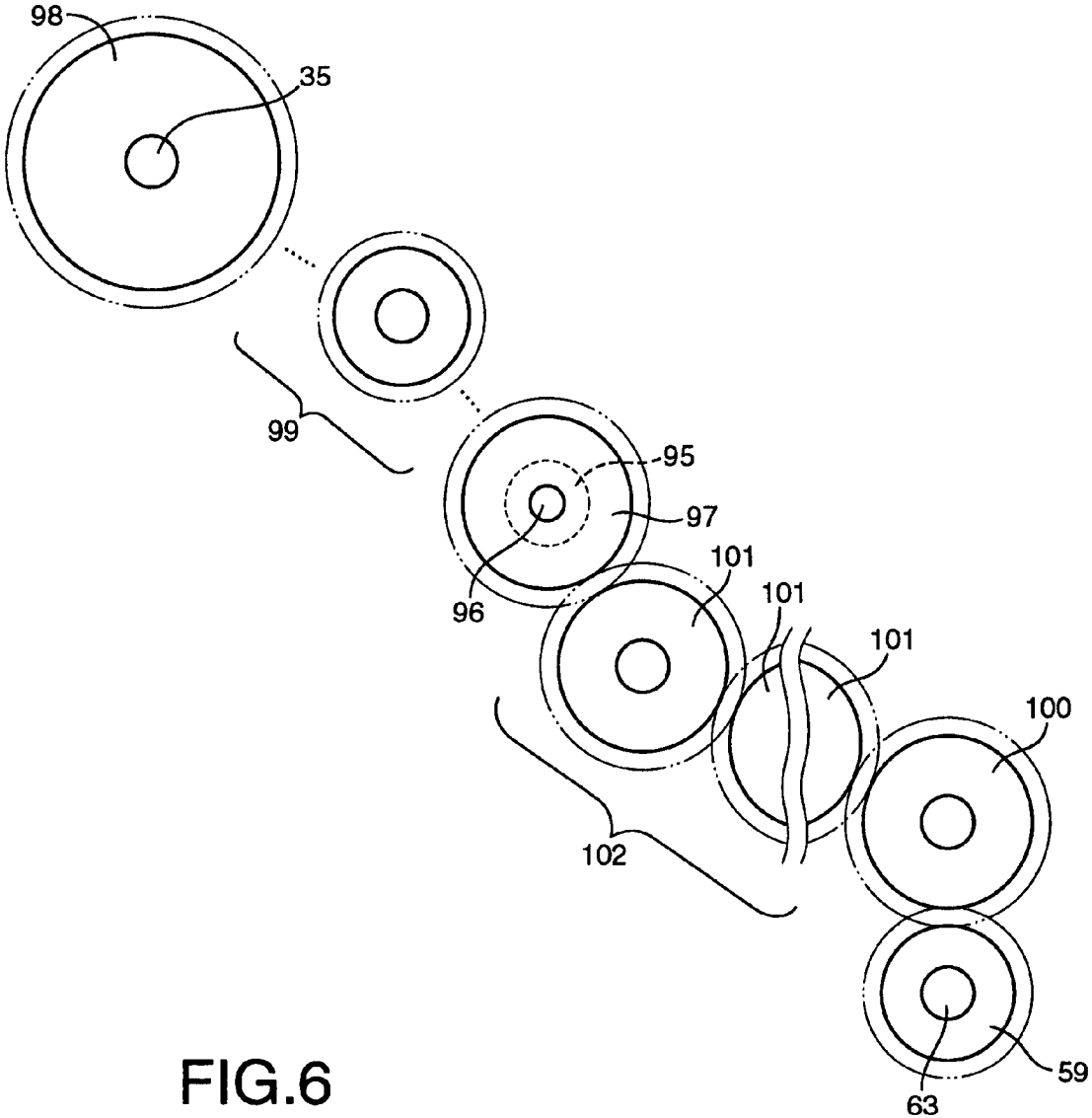
FIG. 6 is a view schematically illustrating a gear transmission mechanism for transmitting a rotational driving force to a photosensitive drum shown in FIG. 1 and the feed drive section shown in FIG. 3.

FIG. 6 schematically illustrates a gear transmission mechanism for transmitting a rotational driving force to both the photosensitive drum 29 and the feed drive section 58. The transmission mechanism, which is disposed at the body casing 2, includes a motor gear 97 which is externally fitted onto an output shaft 96 of the main motor 95 in an anti-rotation manner relative to the output shaft 96. The main motor 95 functions as a first drive source.

The transmission mechanism further includes a drum gear 98 which is rotatably supported at the drum shaft 35 of the photosensitive drum 29, and which is disposed in an anti-rotation manner relative to the drum body 34.

The transmission mechanism still further includes; an intermediate gear group 99 having meshing gears, one end of which meshes with the motor gear 97, the other end of which meshes with the drum gear 98; the output gear 100 in mesh with the input gear 59 of the feed drive section 58; and a transmission gear train 102 in the form of a line of a plurality of transmission gears 101 in mesh with each other.

The transmission gear train 102 meshes with the motor gear 97 and the output gear 100, such that one of the transmission gears 101 located at one end of the line thereof meshes with the motor gear 97, while one of the transmission gears 101 located at the other end of the line thereof meshes with the output gear 100.

Owing to this arrangement, a driving operation of the main motor 95 achieves an integral rotation of the motor gear 97 and the output shaft 96, resulting in the transmission of the rotational driving force of the motor gear 97 to the output gear 100 via the transmission gear train 102. The rotation of the output gear 100 allows the transmission of the rotational driving force from the output gear 100 to the input gear 59.

In addition, the rotational driving force of the motor gear 97 is transmitted to the drum gear 98 via the intermediate gear group 99, resulting in the rotation of the drum gear 98 about the axis of the drum shaft 35. The rotation of the drum gear 98 causes the drum body 34 to be rotated about the axis of the drum shaft 35, integrally with the drum gear 98.

Figure 7:
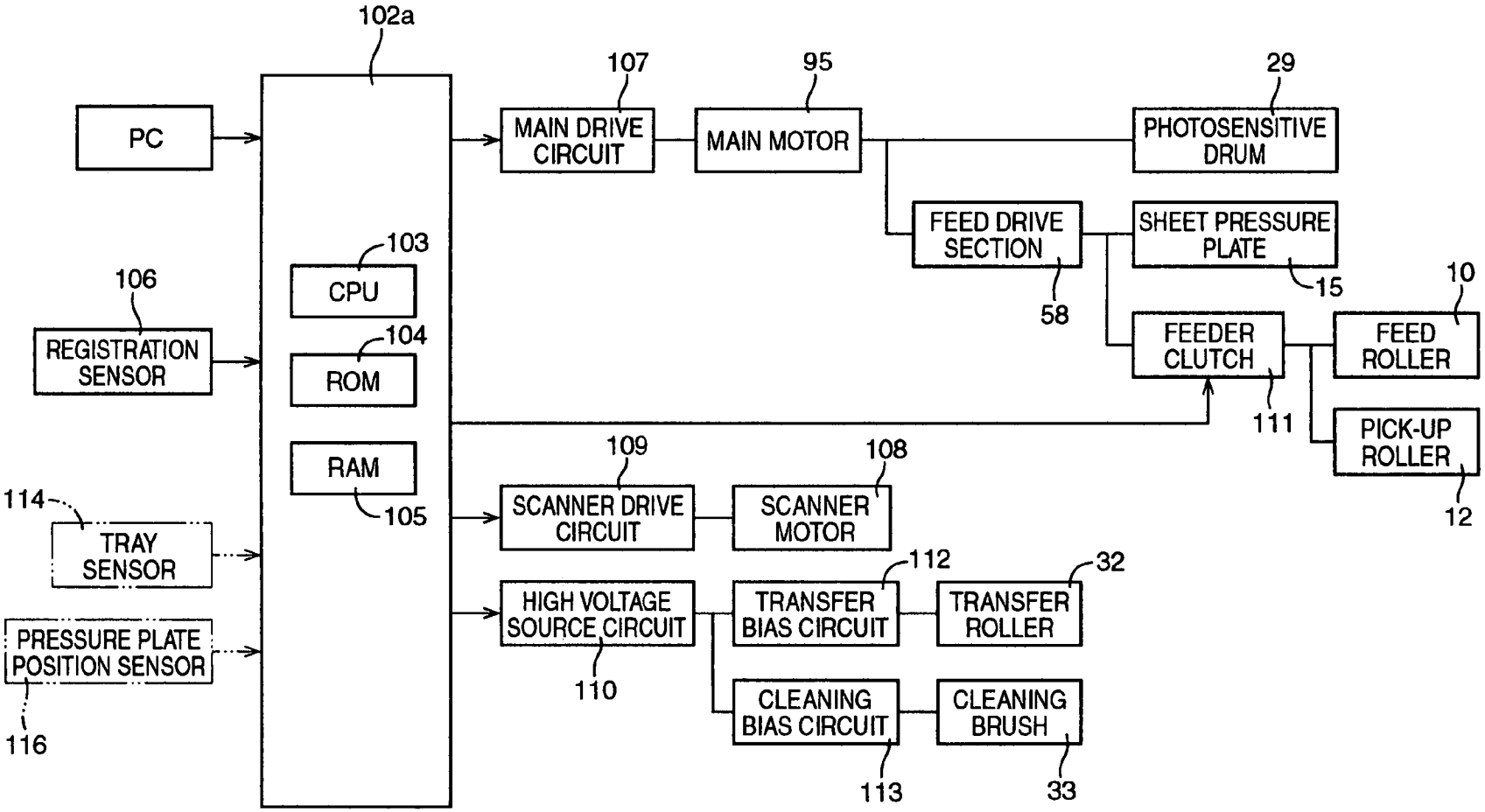
FIG. 7 is a block diagram schematically illustrating an electrical configuration of the laser printer shown in FIG. 1.

FIG. 7 is a block diagram illustrating an electrical configuration of the laser printer 1. The laser printer 1 includes a controller 102*a*.

The controller 102*a* is configured to primarily include a computer having a CPU 103, a ROM 104, and a RAM 105. Suitable operation programs for the laser printer 1 have been previously stored in the ROM 104. The RAM 105 functions as a working area for the CPU 103 to use in executing the operation programs stored in the ROM 104, with values or the like temporarily stored in the RAM 105.

The CPU 103 is electrically coupled with the registration sensor 106, and retrieves the output therefrom. The CPU 103 is also electrically coupled with an external device (a personal computer, for example), and receives from the external device, a command signal for print start instructing the laser printer 1 to form an image.

Further, the CPU 103 is electrically coupled with controlled elements including: a main drive circuit 107 for driving the main motor 95; a scanner drive circuit 109 for driving the scanner motor 108; a high voltage source circuit 110 for generating a high voltage to apply a transfer bias and a cleaning bias; and the feeder clutch 111.

To the high voltage source circuit 110, there are connected a transfer bias circuit 112 that functions as a transfer-bias applicator applying a bias to the transfer roller 32, and a cleaning bias circuit 113 for applying a cleaning bias to the cleaning brush 33.

The CPU 103 controls both the high voltage source circuit 110 and the transfer bias circuit 112, to thereby control the bias applied from the transfer bias circuit 112 to the transfer roller 32. More specifically, by the direction of the CPU 103, there is applied to the transfer roller 32 a selected one of a regular transfer bias to be applied for achieving a transfer of a toner image from the photosensitive drum 29 onto a recording sheet 3 of paper, and a reverse transfer bias to be applied for achieving a movement of a toner from the transfer roller 32 onto the photosensitive drum 32.

Further, the CPU 103 controls the high voltage source circuit 100 and the cleaning bias circuit 113, to thereby control the cleaning bias applied from the cleaning bias circuit 113 to the cleaning brush 33.

Still further, the CPU 103 controls the driving operation of the main motor 95 via the main drive circuit 107. The rotational driving force generated at the main motor 95 as a result of the control is employed to rotate the photosensitive drum 29, as described above. In addition, the rotational driving force generated at the main motor 95, upon being also transmitted to the feed drive section 58, is also employed to drive the sheet pressure plate 15 (lever 17), and also drive both the feed roller 10 and the pick-up roller 12 via the feeder clutch 111.

Further, the rotational driving force generated at the main motor 95, upon being also transmitted to the supply roller 40, the developer roller 41, the transfer roller 32, and the heat roller 49, respectively, is also employed to rotate the supply roller 40, the developer roller 41, the transfer roller 32, and the heat roller 49, as described above.

Still further, the CPU 103 controls the driving operation of the scanner motor 108 via the scanner drive circuit 109.

Figure 8:
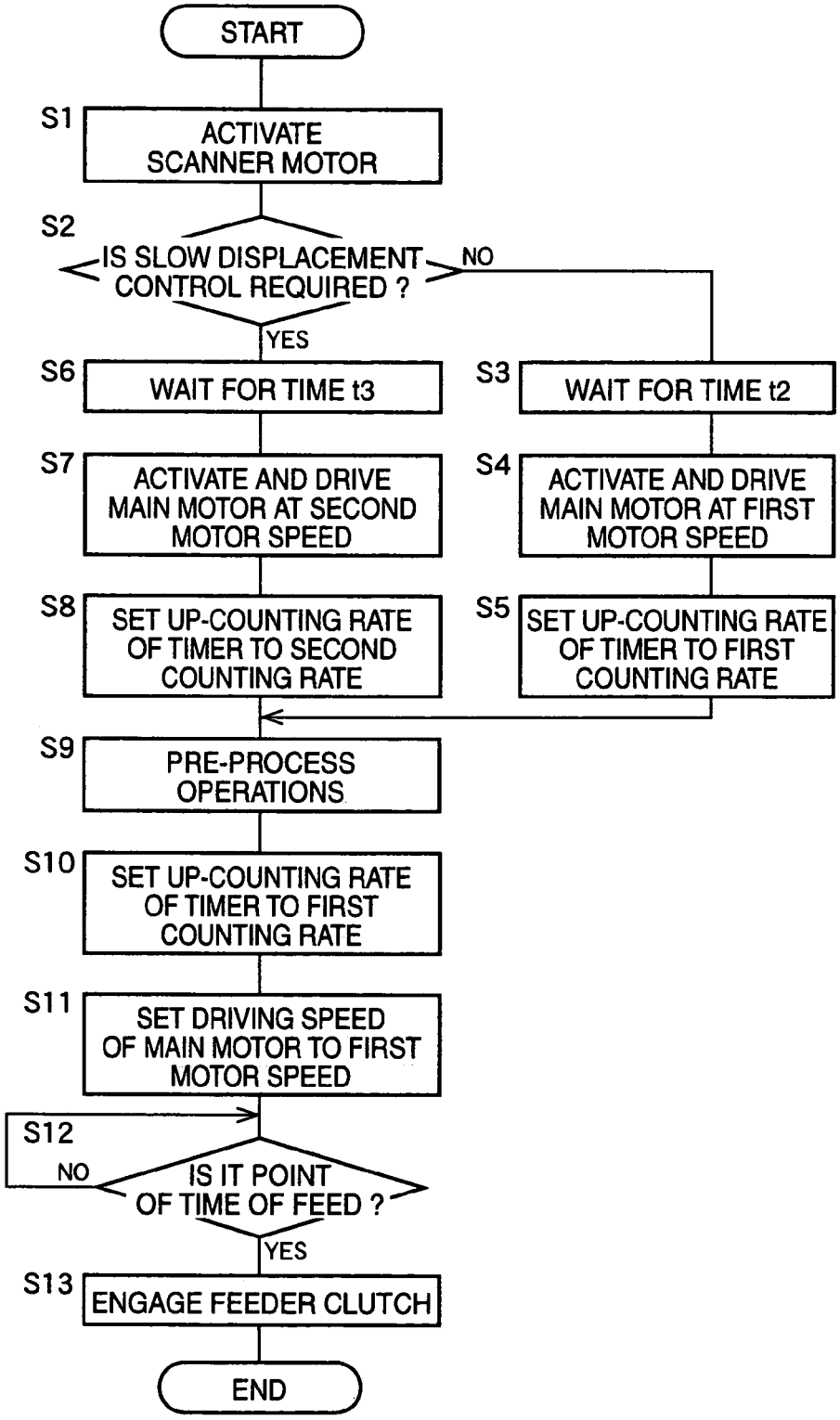
FIG. 8 is a flow chart schematically illustrating a displacement control program for explanation of the flow of a control performed during a period from an entry of a command signal for print start to a CPU shown in FIG. 7, to a start of a sheet feed operation.

FIG. 8 schematically illustrates in flow chart a displacement control program which is one of operation programs executed by the CPU 103, and which is useful in understanding the present invention. The flow chart is also a flow chart illustrating the flow of a control performed during a period from an entry of a command signal for print start to the CPU 103, to a start of feeding out of a recording sheet 3 of paper from the feed tray 9.

Figure 9:
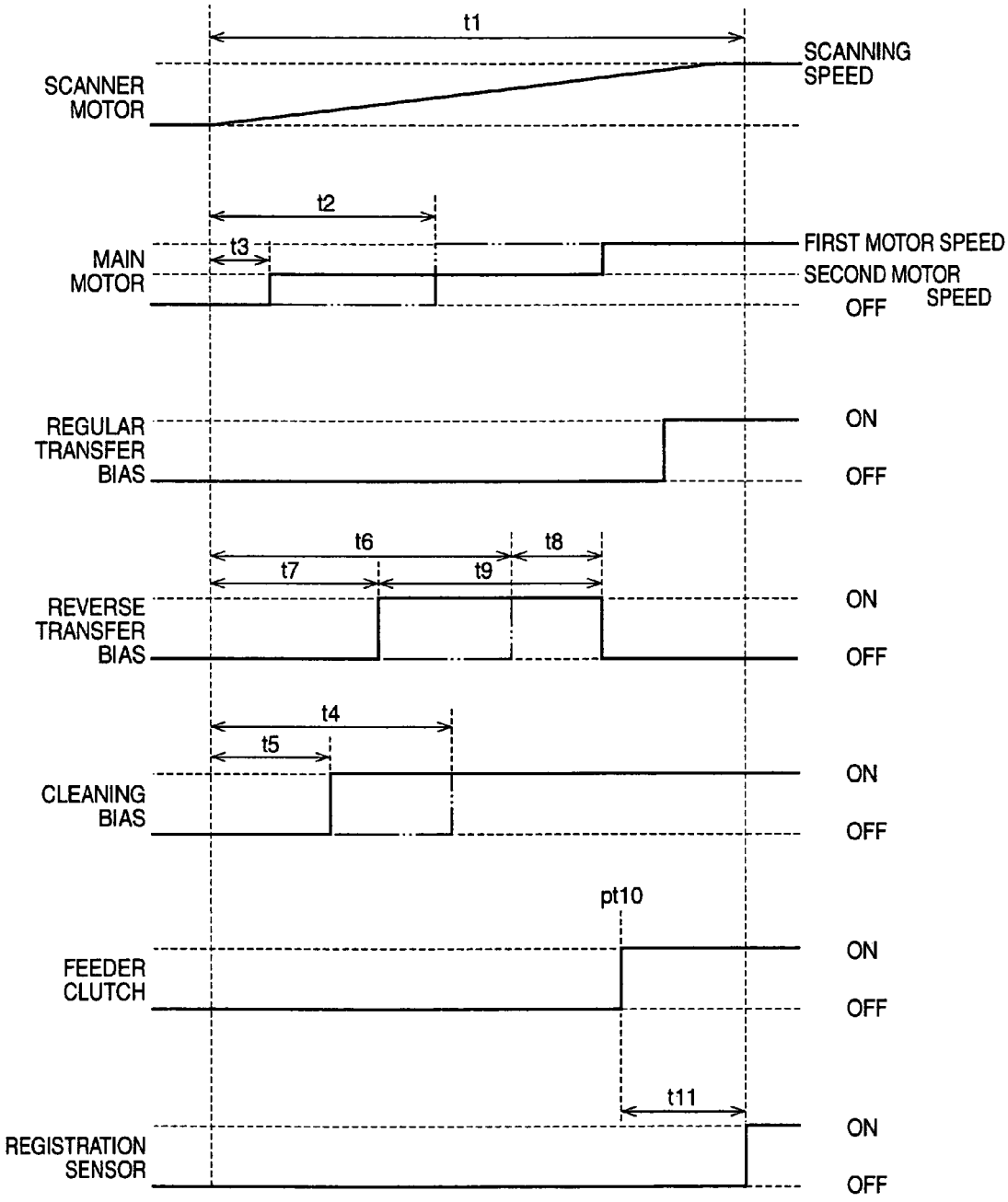
FIG. 9 is a timing chart illustrating operational sequences of components of the laser printer shown in FIG. 1, during the control explained with reference to FIG. 8.

FIG. 9 illustrates in timing chart operational sequences of the components of the laser printer 1 experienced during the above control.

Upon entry of the command signal for print start into the CPU 103, an execution of the displacement control program shown in FIG. 8 is initiated. The displacement control program begins with a step S1 in which the CPU 103 directs the scanner motor 108 to start up.

An unsteady driving speed of the scanner motor 108 during formation of an electrostatic latent image on the photosensitive drum 29 causes variations in rotational speed of the polygon mirror 22, with generation of unintended distortions on the electrostatic latent image formed on the photosensitive drum 29, etc.

To avoid such a drawback, the formation of an electrostatic latent image on the photosensitive drum 29 is performed after elapse of a scanning readiness time t1 since a start time of a driving operation of the scanner motor 108, as shown in FIG. 9. The scanning readiness time t1 is established to have a length of time required to elapse until the driving speed of the scanner motor 108 becomes stable and reaches a scanning start speed allowing a stable scanning of the photosensitive drum 29 with the laser beam using the polygon mirror 22.

The step S1 is followed by a step S2 to determine whether or not a slow displacement control is required to be performed. The slow displacement control is for displacing the sheet pressure plate 15 from the receiving position to the feeding position at a lower speed.

Figure 10:
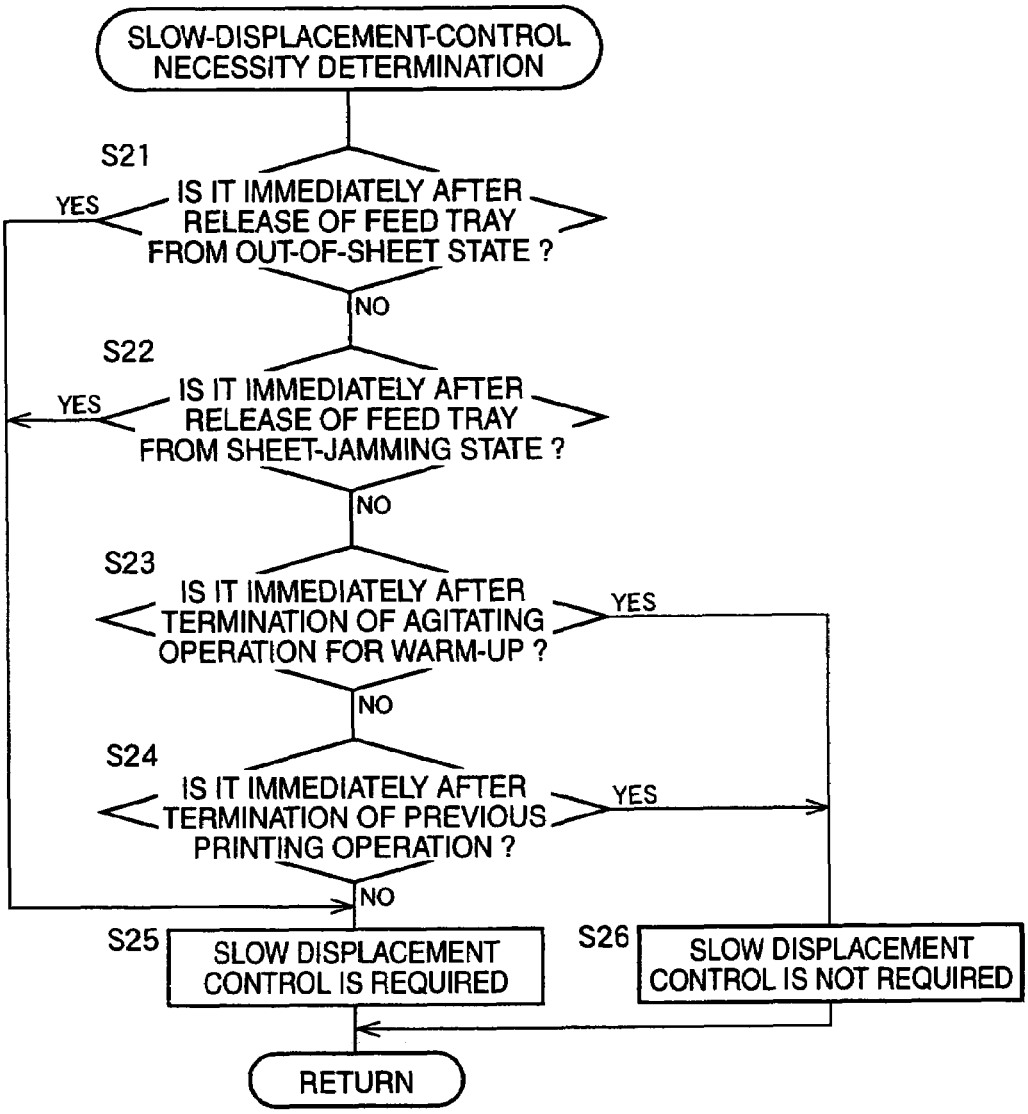
FIG. 10 is a flow chart schematically illustrating a slow-displacement-control necessity determination routine executed for determining whether or not the CPU shown in FIG. 7 is required to perform a slow displacement control.

Describing more specifically with reference to FIG. 10 schematically illustrating in flow chart the details of the step S2 as a slow-displacement-control necessity determination routine, a step S21 is firstly implemented to make a determination as to whether or not it is within a first period having a predetermined length of time elapsed since release of the sheet pressure plate 15 from an out-of-sheet state in which no recording sheet 3 is present on the sheet pressure plate 15, i.e., since the feed tray 9 was lastly refilled or reloaded with fresh recording sheets 3.

If it is within the first period, then the determination of the step S21 becomes affirmative "YES," and the CPU 103 proceeds to a step S25 to determine that the slow displacement control is required to be performed.

If it is not within the first period, then the determination of the step S21 becomes negative "NO," and the CPU 103 proceeds to a step S22. The step S22 is implemented to make a determination as to whether or not it is within a second period having a predetermined length of time elapsed since release of the feed tray 9 from a sheet-jamming state in which a recording sheet 3 jams.

If it is within the second period, then the determination of the step S22 becomes affirmative "YES," and the CPU 103 proceeds to the step S25 to determine that the slow displacement control is required to be performed, as with the previous example case.

If it is not within the second period, then the determination of the step S22 becomes negative "NO," and the CPU 103 proceeds to a step S23. The step S23 is implemented to make a determination as to whether or not it is within a third period having a predetermined length of time elapsed since termination of an agitating operation of the agitator 44 for warming up a toner stored within the toner storage 39.

If it is within the third period, then the determination of the step S23 becomes affirmative "YES," and the CPU 103 proceeds to a step S26 to determine that the slow displacement control is not required to be performed.

If it is not within the third period, then the determination of the step S23 becomes negative "NO," and the CPU 103 proceeds to a step S24. The step S24 is implemented to make a determination as to whether or not it is within a fourth period having a predetermined length of time (about 3 seconds, for example) elapsed since termination of a previous printing operation.

If it is within the fourth period, then the determination of the step S24 becomes affirmative "YES," and the CPU 103 proceeds to the step S26 to determine that the slow displacement control is not required to be performed, as with the previous example case.

If it is neither within the third period nor within the fourth period, then the determinations of the steps S23 and S24 each become negative "NO," and the CPU 103 proceeds to the step S25 to determine that the slow displacement control is required.

The sheet pressure plate 15 is released from the above out-of-sheet state upon loading of new recording sheets 3 onto the sheet pressure plate 15. In view of this, in the present embodiment, it is assumed that, if it is immediately after release of the sheet pressure plate 15 from the out-of-sheet state, then the sheet pressure plate 15 is located at the receiving position.

A release of the sheet pressure plate 15 from the sheet-jamming state requires a removal of a jammed recording sheet 3 from the sheet pressure plate 15 with the feed tray 9 removed from the body casing 2. In light of this, in the present embodiment, it is assumed that, if it is immediately after release of the sheet pressure plate 15 from the sheet-jamming state, then the sheet pressure plate 15 is located at the receiving position.

For the above reasons, in the present embodiment, as described above, if it is immediately after release of the sheet pressure plate 15 from the out-of-sheet state or the sheet-jamming state, it is determined that the above slow displacement control is required.

An agitating operation of the agitator 44 for warm-up is performed immediately before a start time of feed out of a recording sheet 3 from the feed tray 9. In view of this, it is assumed that, if it is within a predetermined length of period after the above agitating operation for warm-up, then the sheet pressure plate 15 is located at the feeding position.

Displacement of the sheet pressure plate 15 from the feeding position to the receiving position is not experienced within a short period since termination of a previous printing operation. In view of this, it is assumed that, if it is within a predetermined length of period after the previous printing operation, then the sheet pressure plate 15 is located at the feeding position.

For the above reasons, in the present embodiment, as described above, if it is within a predetermined length of period after the above agitating operation for warm-up or a previous printing operation, it is determined that the above slow displacement control is not required.

Upon implementation of the step S25 or S26 shown in FIG. 10, one cycle of the implementation of the slow-displacement-control necessity determination routine shown in FIG. 10 is terminated, and the CPU 109 returns to the step S2 shown in FIG. 8.

If the step S2 determines that the slow displacement control is not required, then the determination of the step S2 becomes negative "NO," and the CPU 103 proceeds to a step S3 to wait for a predetermined standby time t2 (see FIG. 9. t2=2.7 seconds, for example) since a start time of a driving operation of the scanner motor 108.

The step S3 is followed by a step S4 to drive the main motor 95 for rotation at a first motor speed (a standard motor speed). The first motor speed is an example of a first driving speed which is a rotational speed of the main motor 95 achieved during feed of a recording sheet 3 from the sheet pressure plate 15.

An end point of the standby time t2, i.e., a start time of a rotational driving operation of the main motor 95 at the first motor speed (shown in dash-dot-dot line in FIG. 9) is established based on a sheet feed point pt10 of time described later in more detail, at which a feed out of a recording sheet 3 from the feed tray 9 is started (see FIG. 9).

More specifically, the standby time t2 is established to allow the sheet pressure plate 15, upon being raised up from the receiving position, to reach the feeding position by the sheet feed point pt10. The length of the standby time t2 may be calculated by subtracting the sum of the length of a time t11 shown in FIG. 9 and a displacement time required for displacing or moving the sheet pressure plate 15 from the receiving position to the feeding position, from the scanning readiness time t1, for example. The length of the displacement time depends on the displacement speed of the sheet pressure plate 15, and eventually depends on the driving speed of the main motor 95.

The step S4 is followed by a step S5 to set an up-counting rate of a count of a timer counter assigned to a portion of the RAM 105, to a predetermined first counting rate (a standard counting rate). The timer counter is activated to measure the length of a time elapsed since a start time of a driving operation of the main motor 95.

In contrast, if the step S2 determines that the slow displacement control is required, then the determination of the step S2 becomes affirmative "YES," and the CPU 103 proceeds to a step S6 to wait for a predetermined standby time t3 (see FIG. 9. 0<=t3<t2) since a start time of a driving operation of the scanner motor 108.

The step S6 is followed by a step S7 to drive for rotation the main motor 95 at a second motor speed. The second motor speed is an example of a second driving speed of the main motor 95 lower than the first motor speed described above.

An end point of the standby time t3, i.e., a start time of a rotational driving operation of the main motor 95 at the second motor speed (shown in solid line in FIG. 9) is established based on the sheet feed point pt10 described later in more detail.

The step S7 is followed by a step S8 to set the up-counting rate of the count of the aforementioned timer counter to a predetermined second counting rate lower than the first counting rate. The timer counter is activated to measure the length of a time elapsed since a start time of a driving operation of the main motor 95.

At that time, the feeder clutch 111 is held disengaged, and therefore, a rotational driving force of the main motor 95 is not transferred to the feed roller 10 and the pick-up roller 12, despite of the rotational driving operation of the main motor 95 at the first or second motor speed, resulting in no rotation of the feed roller 10 and the pick-up roller 12.

The second counting rate is established to be slower than the first counting rate, depending on the ratio of the second motor speed to the first motor speed. For example, where the second motor speed is established to be equal to the half of the first motor speed, the second counting rate is set to the half of the first counting rate.

This results in a coincidence in amount of rotation of the main motor 95 as described below between where the main motor 95 is driven at the first motor speed until the count of the timer counter increases to a predetermined count value at the first counting rate, and where the main motor 95 is driven at the second motor speed until the count of the timer counter increases to the same count value at the second counting rate.

The amount of rotation of the main motor 95, which is an example of the amount of driving operation of the main motor 95, is represented by the integral of the driving speed of the main motor 95 over time. The integral may be calculated, for a constant driving speed operation of the main motor 95, as the product of the constant driving speed of the main motor 95 and the length of a time elapsed with the main motor 95 being driven at the constant driving speed, for example. The amount of rotation of the main motor 95 is represented by the area between the curve and the time axis in FIG. 9.

Where the main motor 95 is driven for rotation at the second motor speed, the input gear 59 of the feed drive section 58 is rotated at a lower speed than where the main motor 95 is driven for rotation at the first motor speed. The relatively slow rotation of the input gear 59 introduces relatively slow rotations of the lever drive gear 61 and the lever shaft 18. This allows the sheet pressure plate 15 to be raised up slowly at its front end, to thereby displace the sheet pressure plate slowly from the receiving position to the feeding position.

As a result, the recording sheet 3 on the sheet pressure plate 15 is brought into pressing contact with the pick-up roller 12 at a reduced speed, facilitating an accurate positioning and stopping of the sheet pressure plate 15 at the feeding position allowing the pick-up roller 12 to pick up suitably the recording sheet 3 from the sheet pressure plate 15.

As shown in FIG. 8, after the step S4 or S7 is implemented to activate the main motor 95 and then a corresponding one of the steps S5 and S8 is implemented to initiate the timer counter, a step S9 is implemented to perform pre-process operations including a transfer cleaning operation, a drum cleaning operation, etc. at respective timings each depending on the current value of the up-counting rate of the timer counter (corresponding to current value of the driving speed of the main motor 95).

More specifically, where the up-counting rate of the timer counter has been set to the first counting rate (higher counting rate), the application of the cleaning bias to the cleaning brush 33 is initiated by the direction of the CPU 103 upon elapse of a predetermined time t4 since a start time of a driving operation of the scanner motor 108, as illustrated in dash-dot-dot line in FIG. 9.

On the other hand, where the up-counting rate of the timer counter has been set to the second counting rate (lower counting rate), the application of the cleaning bias to the cleaning brush 33 is initiated by the direction of the CPU 103 upon elapse of a predetermined time t5 shorter than the time t4 since a start time of a driving operation of the scanner motor 108, as illustrated in solid line in FIG. 9.

Where the up-counting rate of the timer counter has been set to the second counting rate (lower counting rate), the main motor 95 is rotated at the second motor speed (lower motor speed), and therefore, the photosensitive drum 29 is rotated slowly, as compared with the case where the main motor 95 is rotated at the first motor speed (higher motor speed). For this reason, if the cleaning bias is applied to the cleaning brush 33 at the same timing as where the main motor 95 is rotated at the first motor speed, the cleaning operation of the photosensitive drum 29 cannot be completed by the aforementioned sheet feed point pt10 described later in more detail.

To avoid such a drawback, in the present embodiment, where the up-counting rate of the timer counter has been set to the second counting rate, a start time at which the application of the cleaning bias to the cleaning brush 33 starts is expedited than where the up-counting rate of the timer counter has been set to the first counting rate. This allows the completion of the cleaning of the photosensitive drum 29 by the aforementioned sheet feed point pt10 described later in more detail, irrespective of whether the driving speed of the main motor 95 has been set to the first or the second motor speed, resulting in a confident formation of an electrostatic latent image on the photosensitive drum 29.

In addition, where the up-counting rate of the timer counter has been set to the first counting rate (higher counting rate), the application of the reverse transfer bias to the transfer roller 32 is initiated by the direction of the CPU 103 upon elapse of a predetermined time t6 since a start time of a driving operation of the scanner motor 108, and is continued for a predetermined time t8 by the direction of the CPU 103, as illustrated in dash-dot-dot line in FIG. 9.

On the other hand, where the up-counting rate of the timer counter has been set to the second counting rate (lower counting rate), for the same reasons as an event of applying the cleaning bias to the cleaning brush 33, the application of the reverse transfer bias to the transfer roller 32 is initiated by the direction of the CPU 103 upon elapse of a predetermined time t7 shorter than the time t6 since a start time of a driving operation of the scanner motor 108, and is continued for a predetermined time t9 longer than the time t8 by the direction of the CPU 103, as illustrated in solid line in FIG. 9.

This allows the reverse transfer in which a toner is transferred from the transfer roller 32 to the photosensitive drum 29 and in which the transfer roller 32 is cleaned as a result of the application of the reverse transfer bias, to be completed by the aforementioned sheet feed point pt10 described later in more detail, irrespective of whether the driving speed of the main motor 95 has been set to the first or the second motor speed, resulting in a stabilized transfer of a toner image from the photosensitive drum 29 onto a recording sheet 3 of paper.

It is added that, the application of the reverse transfer bias to the transfer roller 32 cannot provide a transfer of a toner charged oppositely in polarity to that when a toner image was transferred onto a recording sheet 3 of paper, from the transfer roller 32 to the photosensitive drum 29. However, the toner charged oppositely in polarity is transferred from the transfer roller 32 to the photosensitive drum 29 and removed from the surface of the transfer roller 32, during an initial period of the entire period during which the regular transfer bias is applied to the transfer roller 32.

The application of the regular transfer bias to the transfer roller 32 is performed after the aforementioned sheet feed point pt10 described later in more detail. This prevents a long-term application of the regular transfer bias to the transfer roller 32, resulting in a prolonged life and improved durability of the transfer roller 32.

After a driving operation of the main motor 95 starts, upon elapse of a displacement time (1.2 seconds, for example) required for displacing the sheet pressure plate 15 from the receiving position to the feeding position, a step S10 shown in FIG. 8 is implemented to set the up-counting rate of the aforementioned timer counter to the first counting rate (higher counting rate), and then a step S11 is implemented to set the driving speed of the main motor 95 to the first motor speed (higher motor speed), even though the driving speed of the main motor 95 was originally set to the second motor speed (lower motor speed). These implementations cause the main motor 95 to be driven for rotation at the first motor speed after the aforementioned sheet feed point pt10.

It is added that, in the absence of the slow displacement control, the step S4 is implemented to activate and drive the main motor 95 at the first motor speed, and the step S5 is implemented to set the up-counting rate of the aforementioned timer counter to the first counting rate, resulting in the subsequent steps S10 and S11 making no substantial modification to the driving speed of the main motor 95 and the up-counting rate of the timer counter.

As shown in FIG. 8, the step S11 is followed by a step S12 to make a determination as to whether or not the sheet feed point pt10 is reached. The sheet feed point pt may be defined relative to a start time of a driving operation of the scanner motor 108, for example. In this example, information of the sheet feed point pt10 may be stored in the ROM 104, and the information may be retrieved from the ROM 104 in response to the implementation of the step S11.

Describing how to establish the sheet feed point pt10 with reference to FIG. 9, this requires the establishment of a transfer point of time at which a toner image is transferred from the photosensitive drum 29 to a recording sheet 3 of paper. The transfer point of time is established by making allowances for the length of the scanning readiness time t1. For example, the transfer point may be established to allow the driving speed of the scanner motor 108 to substantially achieve the ultimate driving speed in proximity to the transfer point of time.

Subsequently, the sheet feed point pt10 is so established by making allowances for the length of the time t11 required for the recording sheet 3 to move from the sheet pressure plate 15 to the registration rollers 14, 14, as to allow the recording sheet 3 to reach a transfer position disposed between the photosensitive drum 29 and the transfer roller 32, by the above transfer point of time.

If the sheet feed point pt10 is reached, then the determination of the step S12 shown in FIG. 8 becomes affirmative "YES," and the CPU 103 proceeds to a step S13 to switch the feeder clutch 111 from an off state to an on state for engaging the feeder clutch 111. This allows translation of a rotational driving force from the main motor 95 to the pick-up roller 12, causing the pick-up roller 12 to rotate for picking up and feeding out the uppermost one of recording sheets 3 stacked on the sheet pressure plate 15.

At this time, a pressing contact is achieved between the recording sheets 3 on the sheet pressure plate 15 and the pick-up roller 12, with a substantially constant pressing force acting therebetween. Therefore, the present embodiment allows feeding out of the uppermost recording sheet 3 on the sheet pressure plate 15 without causing double sheet feed or sheet misfeed from the sheet pressure plate 15.

The above pressing contact does not create the risk that the sheet pressure plate 15 is slightly oscillated each pick-up event of a recording sheet 3 on the sheet pressure plate 15. Therefore, the present embodiment facilitates reduction in noise during continuous feed out of the recording sheets 3 from the feed tray 9.

Further, the present embodiment allows the rotational driving force of the main motor 95 to apply to both the photosensitive drum 29 and the sheet pressure plate 15 (lever 17), enabling the main motor 95 to function as a common drive source to both the photosensitive drum 29 and the sheet pressure plate 15. This eliminates increase in manufacturing cost.

Still further, the above-described slow displacement control allows the sheet pressure plate 15 to be displaced from the receiving position to the feeding position at a reduced speed. This facilitates improvement in accuracy with which the sheet pressure plate 15 is positioned at the feeding position without shortening the life of the photosensitive drum 29, for the reasons described below.

An increase in gear ratio of the lever drive gear 61 (see FIG. 3) to the motor gear 97 (see FIG. 6) achieves a reduction in displacement speed of the sheet pressure plate 15. However, an increase in the gear ratio of the lever drive gear 61 induces an increase in the amount of rotation (a driving operation) of the main motor 95 required for displacing the sheet pressure plate 15 from the receiving position (lowered position) to the feeding position (raised position), additionally inviting an increase in amount of movement of the photosensitive drum 29. The photosensitive drum 29 is driven together with the sheet pressure plate 15 by the driving force of the main motor 95.

The photosensitive drum 29 is moved in contact with peripherals such as the transfer roller 32, the cleaning brush 33, and the developer roller 41, and therefore, the longer the photosensitive drum 29 moves or rotates, the more the photosensitive drum 29 is degraded. As a result, an increase in the gear ratio of the lever drive gear 61 causes a shortened life of the photosensitive drum 29.

In the present embodiment, a reduction in displacement speed of the sheet pressure plate 15, which is conducive to an improvement in accuracy of positioning the sheet pressure plate 15 at the feeding position, is accomplished by reduction in driving speed of the main motor 95, instead of increase in the gear ratio of the lever drive gear 61. The reduction in driving speed of the main motor 95 does not require an increase in amount of movement of the photosensitive drum 29 experienced during the displacement of the sheet pressure plate 15 from the receiving position to the feeding position. That is, the amount of movement of the photosensitive drum 29 remains unchanged.

With this in mind, in the present embodiment, during implementation of the slow displacement control, the driving speed of the main motor 95 is reduced for reducing the moving speed of the sheet pressure plate 15, without shortening the life of the photosensitive drum 29, resulting in an increase in accuracy in positioning the sheet pressure plate 15 at the feeding position.

As described above, in the present embodiment, irrespective of whether or not the slow displacement control is performed, the aforementioned transfer point of time is established by making allowances for the scanning readiness time t1, the sheet feed point pt10 is established by making allowances for the established transfer point of time, and the start times of the main motor 95 for the slow displacement control and the standard displacement control, respectively, are established by making allowances for the established sheet feed point pt10.

Therefore, the present embodiment enables the transfer of a developer image from the photosensitive drum 29 to a recording sheet 3 of paper delivered to the photosensitive drum 29, at a timing common to where the slow displacement control is performed and where the standard displacement control is performed. In other words, the present embodiment does not require any delay of the transfer point of time due to implementation of the slow displacement control.

As a result, the present embodiment allows the transfer of a developer image onto a recording sheet 3 to be completed within the same period as with the case where the main motor 95 is driven at the first motor speed higher than the second motor speed which is to be achieved during the slow displacement control.

As described above, in the present embodiment, irrespective of whether or not the slow displacement control is performed, the start times of the main motor 95 for the slow displacement control and the standard displacement control, respectively, are established to be after the start time of a driving operation of the scanner motor 108. This means that the start time of each displacement event of the sheet pressure plate 15 and the start time of each feed out event of a recording sheet 3 of paper are each established to be reached within the scanning readiness period t1.

For enabling a recording sheet 3 to reach the photosensitive drum 29 by the aforementioned transfer point of time, if the start time of displacement of the sheet pressure plate 15 is set to a time before a start time of a driving operation of the scanner motor 108, a time length which is required for forming an image and which is measured from a start point of an image forming operation to the aforementioned transfer point of time, is prolonged due to implementation of the slow displacement control.

In contrast, the present embodiment, because of the setting of both the start time of each displacement event of the sheet pressure plate 15 and the start time of each feed out event of a recording sheet 3 of paper, to a time after a start time of a driving operation of the scanner motor 108, prevents a prolongation of the time length required for forming an image due to implementation of the slow displacement control.

Further, in the present embodiment, as described above, a driving operation of the main motor 95 starts upon elapse of a corresponding one of the standby times t2 and t3 since a start time of a driving operation of the scanner motor 108. As a result, there is a difference in start time of a driving operation between the main motor 95 and the scanner motor 108.

Therefore, the present embodiment prevents an increase in instantaneous load on a power source unit (not shown) for supplying power commonly to both the main motor 95 and the scanner motor 108, allowing a stabilized power supply of the power source unit to the main motor 95 and the scanner motor 108, resulting in the respective stabilized operations of the main motor 95 and the scanner motor 108.

Figure 11:
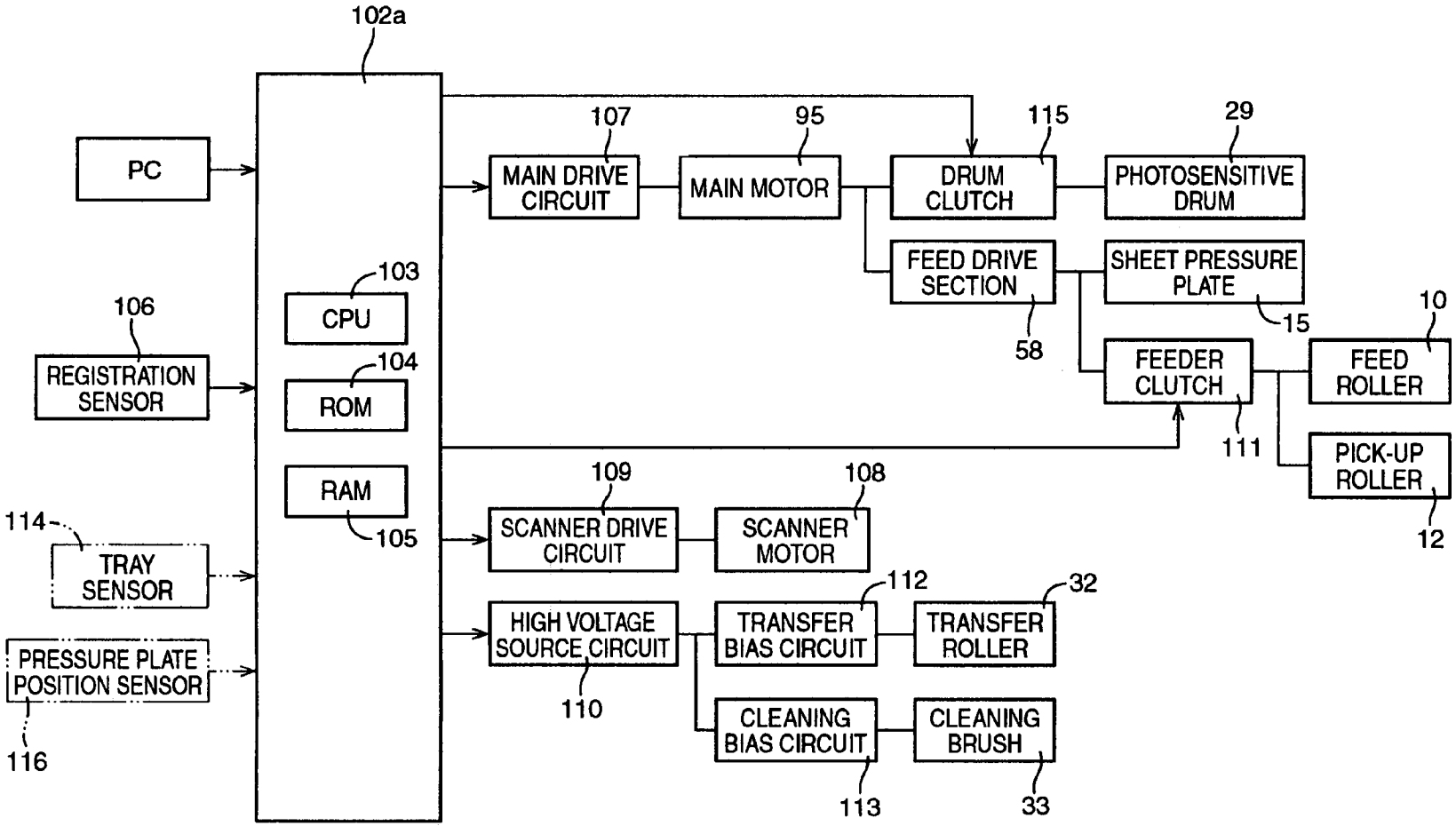
FIG. 11 is a block diagram schematically illustrating an electrical configuration of a laser printer according to a second embodiment of the present invention, the laser printer including a drum clutch.

Then, with reference to FIG. 11, a second embodiment of the present invention will be described. FIG. 11 schematically illustrates in block diagram a laser printer 1 constructed according to the second embodiment, in a similar illustrating manner to FIG. 7 illustrating the electrical configuration of the laser printer 1 constructed according to the first embodiment described above.

Ones of the components of the laser printer 1 according to the present embodiment common to those of the first embodiment are referenced in FIG. 11 the same reference numerals as those in FIG. 7, the details of which will be omitted in description below.

The laser printer 1 according to the present embodiment includes a drum clutch 115 in the form of an electromagnetic clutch as a shifter. The drum clutch 115, which is interposed between gears of the intermediate gear group 99 (see FIG. 6), and which is interposed between the main motor 95 and the photosensitive drum 29, as shown in FIG. 11, is electrically coupled as a controlled element with the controller 102*a* including the CPU 103.

The CPU 103 executes operation programs stored in the ROM 104 for controlling an on/off state (an engaged/disengaged state) of the drum clutch 115, to thereby control the connection between the motor gear 97 (see FIG. 6) and the drum gear 98 (see FIG. 6), with respect to whether the rotational driving force is transferred from the motor gear 97 to the drum gear 98, or interrupted.

In the laser printer 1 according to the present embodiment, the gear ratio of the lever drive gear 61 to the motor gear 97 has been established to be higher than that of the laser printer 1 according to the first embodiment. This enables the displacement of the sheet pressure plate 15 from the receiving position to the feeding position, even where the main motor 95 is driven at the first motor speed (higher motor speed), to be effected at a speed as low as where the main motor 95 is driven at the second motor speed (lower motor speed).

Figure 12:
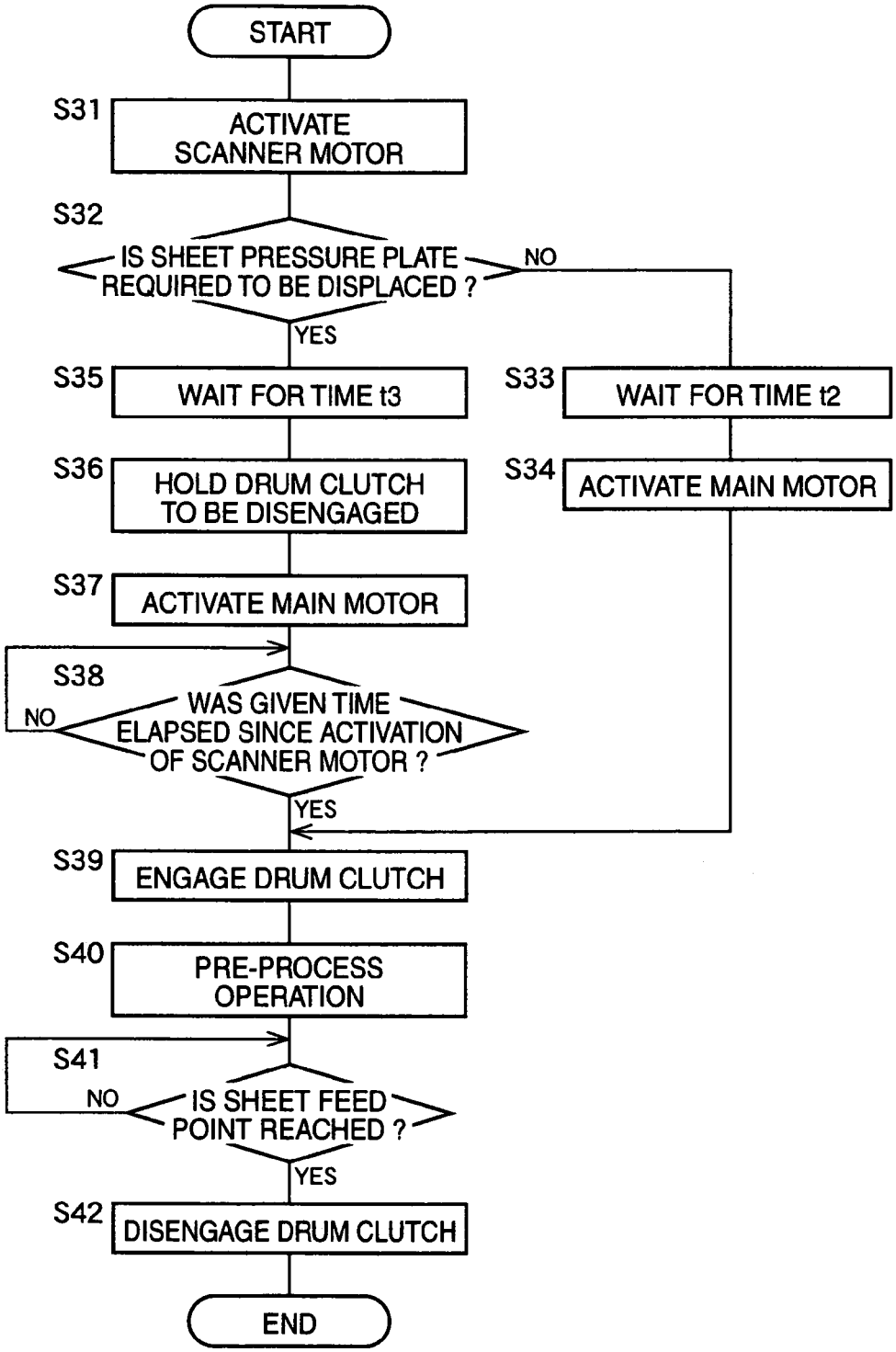
FIG. 12 is a flow chart schematically illustrating a displacement control program for explanation of the flow of a control performed during a period from an entry of a command signal for print start to a CPU shown in FIG. 11, to a start of a sheet feed operation.
Figure 13:
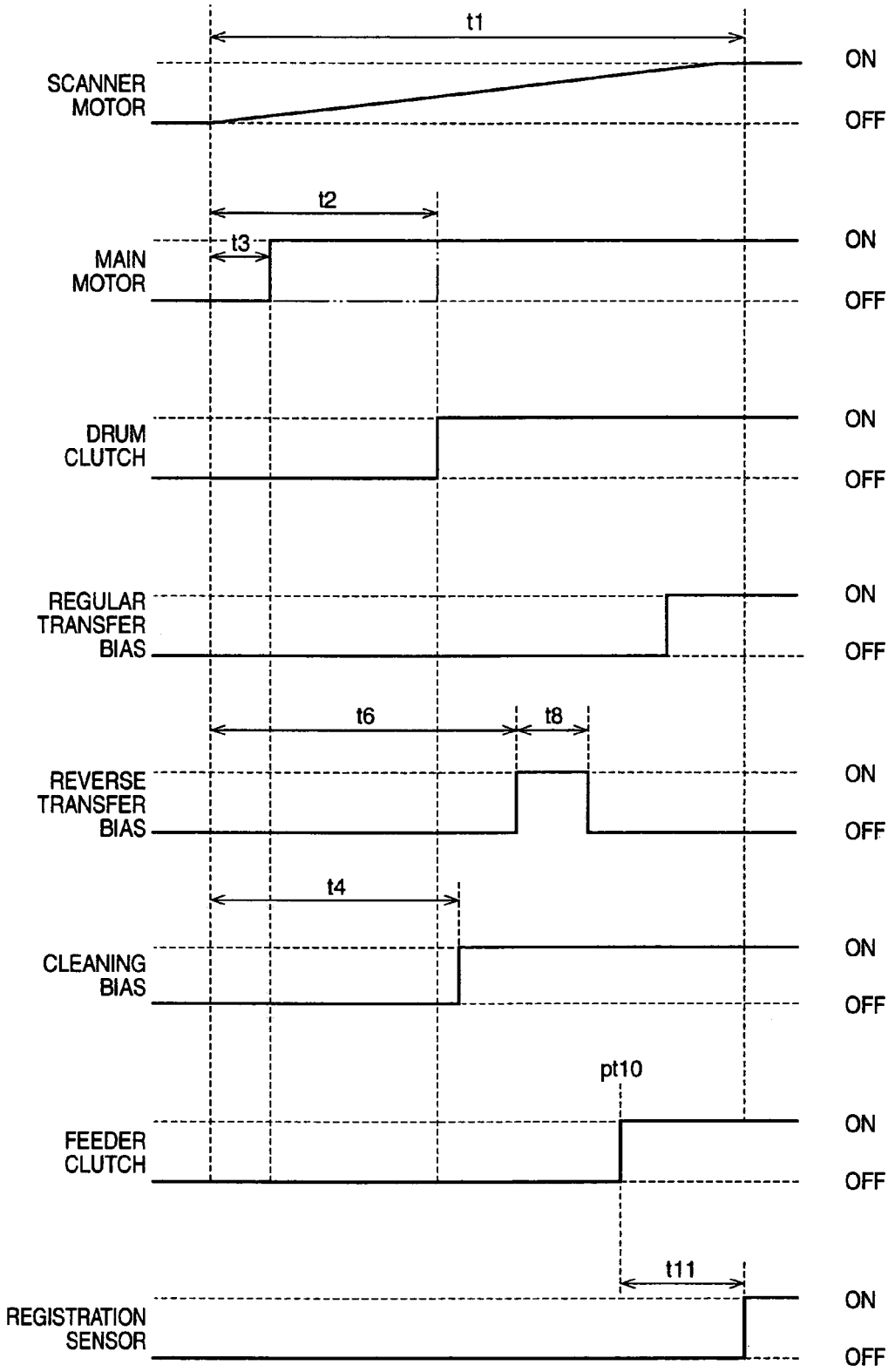
FIG. 13 is a timing chart illustrating operational sequences of components of the laser printer shown in FIG. 11, during the control explained with reference to FIG. 12.

FIG. 12 schematically illustrates in flow chart a displacement control program which is one of operation programs executed by the CPU 103 of the laser printer 1 according to the present embodiment, and which is useful in understanding the present invention. The flow chart is also a flow chart illustrating the flow of a control performed during a period from an entry of a command signal for print start to the CPU 103, to a start time of feeding out of a recording sheet 3 of paper from the feed tray 9. FIG. 13 illustrates in timing chart operational sequences of the components of the laser printer 1 experienced during the above control.

Then, the displacement control program will be described below with reference to FIGS. 12 and 13, partial steps of which are common to those shown in FIG. 8 will be described briefly.

Upon entry of the command signal for print start into the CPU 103, an execution of the displacement control program shown in FIG. 12 is initiated. The displacement control program begins with a step S31 in which the CPU 103 directs the scanner motor 108 to start up.

The step S31 is followed by a step S32 to determine whether or not the displacement of the sheet pressure plate 15 from the receiving position to the feeding position is required. The determination of the S32 is effected in a similar manner to the slow-displacement-control necessity determination routine shown in FIG. 10, which is executed by the CPU 103 for determining whether or not the slow displacement control is required, as described above.

More specifically, if it is immediately after release of the feed tray 9 from the out-of-sheet state, then it is determined that, because of the sheet pressure plate 15 being located at the receiving position, the displacement of the sheet pressure plate 15 to the feeding position is required. If it is immediately after release of the feed tray 9 from the sheet-jamming state, then it is determined that, because of the sheet pressure plate 15 being located at the receiving position, the displacement of the sheet pressure plate 15 to the feeding position is required, as well.

On the other hand, if it is immediately after termination of the agitating operation of the agitator 44 for warm-up, then it is determined that, because of the sheet pressure plate 15 being already located at the feeding position, the displacement of the sheet pressure plate 15 to the feeding position is not required. If it is immediately after termination of a previous printing operation, then it is determined that, because of the sheet pressure plate 15 being already located at the feeding position, the displacement of the sheet pressure plate 15 to the feeding position is not required, as well.

If the step S32 determines that, because of the sheet pressure plate 15 being already located at the feeding position, there is no need of displacing the sheet pressure plate 15 to the feeding position, then the determination of the step S32 becomes negative "NO," and the CPU 103 proceeds to a step S33 to wait for the predetermined standby time t2 (see FIG. 13. t2=2.7 seconds, for example) since a start time of a driving operation of the scanner motor 108.

The step S33 is followed by a step S34 to drive the main motor 95 for rotation at the first motor speed. The step S34 is immediately followed by a step S39 to switch the drum clutch 115 to an on-state, to thereby bring the drum clutch 115 into an engaged state, substantially concurrently with the start of the driving operation of the main motor 95. The drum clutch 115 therefore enters a transferable state allowing transfer of the rotational driving force from the main motor 95 to the drum gear 98.

On the other hand, if the step S32 determines that there is a need of displacing the sheet pressure plate 15 to the feeding position, then the determination of the step S32 becomes affirmative "YES," and the CPU 103 proceeds to a step S35 to wait for the predetermined standby time t3 (see FIG. 9. 0<=t3<t2) since a start time of a driving operation of the scanner motor 108.

The step S35 is followed by a step S36 not to switch the drum clutch 115 to an on-state (engaged state), but to hold it at an off-state (disengaged state), to thereby continue a state in which a transfer of a rotational driving force from the main motor 95 to the drum gear 98 is interrupted. The step S36 is followed by a step S37 to drive for rotation the main motor 95 at the second motor speed.

Upon the main motor 95 being driven for rotation at the second motor speed, the rotational driving force is transferred from the main motor 95 to the feed drive section 58, resulting in a slow pivotal movement of the lever 17. This movement causes the sheet pressure plate 15 to rise up at its front end, with the sheet pressure plate 15 being displaced slowly from the receiving position to the feeding position. As a result, the recording sheet 3 on the sheet pressure plate 15 is brought into pressing contact with the pick-up roller 12 at a reduced speed.

At that time, the feeder clutch 111 is held disengaged, and therefore, the rotational driving force of the main motor 95 is not transferred to the feed roller 10 and the pick-up roller 12, despite of the rotational driving operation of the main motor 95 at the first or second motor speed, resulting in no rotation of the feed roller 10 and the pick-up roller 12.

The step S37 is followed by a step S38 to make a determination as to whether or not a predetermined length of time (e.g., the standby time t2) has been elapsed since the start time of a driving operation of the scanner motor 108. If the predetermined length of time has not yet been elapsed, then the determination of the step S38 becomes negative "NO," and the CPU 103 implements the step S38 again. In contrast, if the determined length of time has been elapsed, then the determination of the step S38 becomes affirmative "YES," and the CPU 103 immediately proceeds to the step S39.

In the step S39, the drum clutch 115 is shifted to an on-state, and becomes engaged, allowing transfer of the rotational driving force from the main motor 95 to the drum gear 98.

Upon a switching event of the drum clutch 115 to an on-state, a step S40 is implemented to perform the preprocess operations including the transfer cleaning operation, the drum cleaning operation, etc. at respective timings.

More specifically, as shown in FIG. 13, the application of the cleaning bias to the cleaning brush 33 is initiated by the direction of the CPU 103 upon elapse of the predetermined time t4 since a start time of a driving operation of the scanner motor 108. In addition, the application of the reverse transfer bias to the transfer roller 32 is initiated by the direction of the CPU 103 upon elapse of the predetermined time t6 since a start time of a driving operation of the scanner motor 108, and is continued for the predetermined time t8 by the direction of the CPU 103.

In the present embodiment, the transfer point of time at which a toner image is transferred from the photosensitive drum 29 to a recording sheet 3 of paper is established by making allowances for the length of the scanning readiness time t1.

Further, the sheet feed point pt10 at which feeding out of a recording sheet 3 of paper from the feed tray 9 is initiated is so established by making allowances for the time t11 required for a recording sheet 3 to move from the sheet pressure plate 15 to the registration rollers 14, 14, as to allow the recording sheet 3 to reach by the established transfer point of time, the transfer position disposed between the photosensitive drum 29 and the transfer roller 32.

Still further, the predetermined times t4 and t6 are each established to allow the transfer cleaning operation and the drum cleaning operation to be completed by the established sheet feed point pt10.

Owing to the above arrangement, the cleaning of the photosensitive drum 29 can be completed by the sheet feed point pt10, allowing a confident formation of an electrostatic latent image on the photosensitive drum 29. Further, the transfer of a toner from the transfer roller 32 onto the photosensitive drum 29 can be completed by the sheet feed point pt10, with the result that the application of the reverse transfer bias allows the cleaning of the transfer roller 32. For this reason, the transfer of a toner image onto a recording sheet 3 is stabilized.

Upon implementation of the step S40, a step S41 is implemented to make a determination as to whether or not the sheet feed point pt10 is reached. If the sheet feed point pt10 is reached, then the determination of the step S41 becomes affirmative "YES," and the CPU 103 proceeds to a step S42 to switch the feeder clutch 111 to an on-state for bringing the feeder clutch 111 into engagement.

This permits the transfer of the rotational driving force from the main motor 95 to the pick-up roller 12, resulting in rotation of the pick-up roller 12. Because of the rotation, the uppermost recording sheet 3 on the sheet pressure plate 15 is picked up and fed out from the feed tray 9.

The application of the regular transfer bias to the transfer roller 32 is performed after the sheet feed point pt10 is reached. This prevents a long-term application of the regular transfer bias to the transfer roller 32, resulting in a prolonged life and improved durability of the transfer roller 32.

As will be readily understood from the above, in the laser printer 1 according to the present embodiment, upon start of the driving operation of the main motor 95 for displacing the sheet pressure plate 15 from the receiving position to the feeding position, the drum clutch 115, despite of that, is held disengaged for a predetermined length of time since the start of the driving operation of the main motor 95, resulting in the photosensitive drum 29 being held stationary. This arrangement suppresses degradation of the photosensitive drum 29 due to its driving operation for the reasons described above, contributing to a prolonged life of the photosensitive drum 29.

In the present embodiment, the aforementioned transfer point of time is established by making allowances for the length of the scanning readiness time t1, the sheet feed point pt10 is established by making allowances for the established transfer point of time, and a point of time at which the drum clutch 115 is brought into engagement is established by making allowances for the established sheet feed point pt10.

Therefore, the present embodiment enables the transfer of a developer image from the photosensitive drum 29 to a recording sheet 3 of paper delivered to the photosensitive drum 29, without any delay of the transfer point of time due to displacement of the sheet pressure plate 15 from the receiving position to the feeding position.

As a result, the present embodiment allows the transfer of a developer image onto a recording sheet 3 to be completed within the same period as with the case where the displacement of the sheet pressure plate 15 to the feeding position is not effected.

Further, in the present embodiment, as described above, the start time of a driving operation of the main motor 95 is established to be after the start time of a driving operation of the scanner motor 108. Therefore, the present embodiment prevents a prolongation of the time length required for forming an image.

Still further, in the present embodiment, as described above, a driving operation of the main motor 95 starts upon elapse of a corresponding one of the standby times t2 and t3 since a start time of a driving operation of the scanner motor 108. As a result, there is a difference in start time of a driving operation between the main motor 95 and the scanner motor 108.

Therefore, the present embodiment prevents an increase in instantaneous load on a power source unit (not shown) for supplying power commonly to both the main motor 95 and the scanner motor 108, allowing a stabilized power supply of the power source unit to the main motor 95 and the scanner motor 108, resulting in the respective stabilized operations of the main motor 95 and the scanner motor 108.

Then, a third embodiment of the present invention will be described with reference to FIGS. 1, 7, and 14.

A laser printer 1 according to the present embodiment includes components identical in construction to those of the laser printer 1 according to the first embodiment shown in FIGS. 1 and 7. The laser printer 1 according to the present embodiment further includes a tray sensor 114 shown in phantom line in FIGS. 1 and 7.

As shown in phantom line in FIG. 1, the tray sensor 114 is disposed at the body casing 2, and functions as a sensor detecting whether or not the feed tray 9 has been attached to the body casing 2. As shown in phantom line in FIG. 7, the output from the tray sensor 114 enters the CPU 103.

The tray sensor 114 may be a contact-type sensor, for example, which is configured to detect an attached state in which the feed tray 9 has been attached to the body casing 2, in response to the tray sensor 114's mechanical contact with the rear end of the body casing 2 upon the feed tray 9 being attached to the body casing 2.

Figure 14:
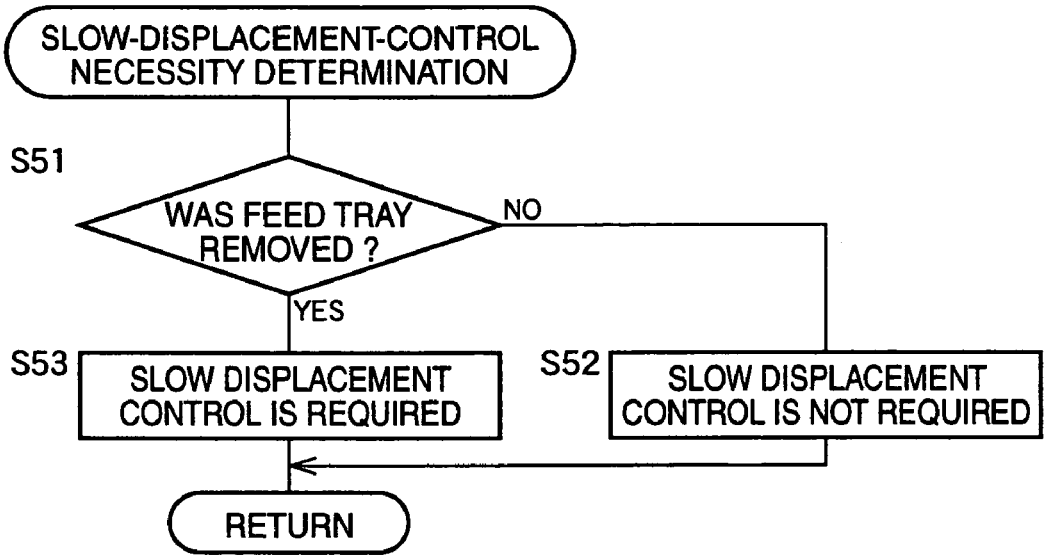
FIG. 14 is a flow chart schematically illustrating a slow-displacement-control necessity determination routine executed for making a determination as to whether or not a CPU of a laser printer according to a third embodiment of the present invention is required to perform a slow displacement control, the determination being made based on an output of a sensor for detecting whether or not a tray is present.

In the present embodiment, the CPU 103 executes a slow-displacement-control necessity determination routine schematically illustrated in flow chart in FIG. 14, instead of that illustrated in FIG. 10.

In the slow-displacement-control necessity determination routine shown in FIG. 14, a step S51 is implemented to make a determination as to whether or not the tray sensor 114 continues to detect the attached state of the feed tray 9 because the feed tray 9 is not removed from the body casing 2 still after a previous printing operation. If the tray sensor 114 continues to detect the attached state of the feed tray 9, then the determination of the step S51 becomes negative "NO," and the CPU 103 proceeds to a step S52 to determine that the slow displacement control is not required.

Loading of recording sheets 3 in the feed tray 9 and reception of the loaded recording sheets 3 on the sheet pressure plate 15 require removal of the feed tray 9 from the body casing 2. In light of this, it can be estimated that, while the feed tray 9 is held attached to the body casing 2, the sheet pressure plate 15 is located at the feeding position. In addition, if the sheet pressure plate 15 is located at the feeding position, there is no need of displacing the sheet pressure plate 15 from the receiving position to the feeding position, and therefore, it can be reasonably determined that there is no need of performing the slow displacement control.

In contrast, if the tray sensor 114 detects a removal of the feed tray 9 from the body casing 2 after a previous printing operation, then the determination of the step S51 becomes affirmative "YES," and the CPU 103 proceeds to a step S53 to determine that, because of the sheet pressure plate 15 being located at the receiving position, the slow displacement control is required.

Then, a fourth embodiment of the present invention will be described with reference to FIGS. 2, 7, and 15.

A laser printer 1 according to the present embodiment includes components identical in construction to those of the laser printer 1 according to the first embodiment shown in FIGS. 1, 2 and 7. The laser printer 1 according to the present embodiment further includes a pressure plate position sensor 116 shown in phantom line in FIGS. 2 and 7.

As shown in phantom line in FIG. 2, the pressure plate position sensor 116 is disposed at the body casing 2, and functions as a sensor detecting whether or not the sheet pressure plate 15 is located at the feeding position with the feed tray 9 attached to the body casing 2. As shown in phantom line in FIG. 7, the output from the pressure plate position sensor 116 enters the CPU 103.

The pressure plate position sensor 116 may be a photo-interrupt-type sensor, for example, which is configured to include a light emitter and a light receiver disposed to allow an optical path between the light emitter and the light receiver to be interrupted in response to the positioning of the sheet pressure plate 15 at the receiving position.

Figure 15:
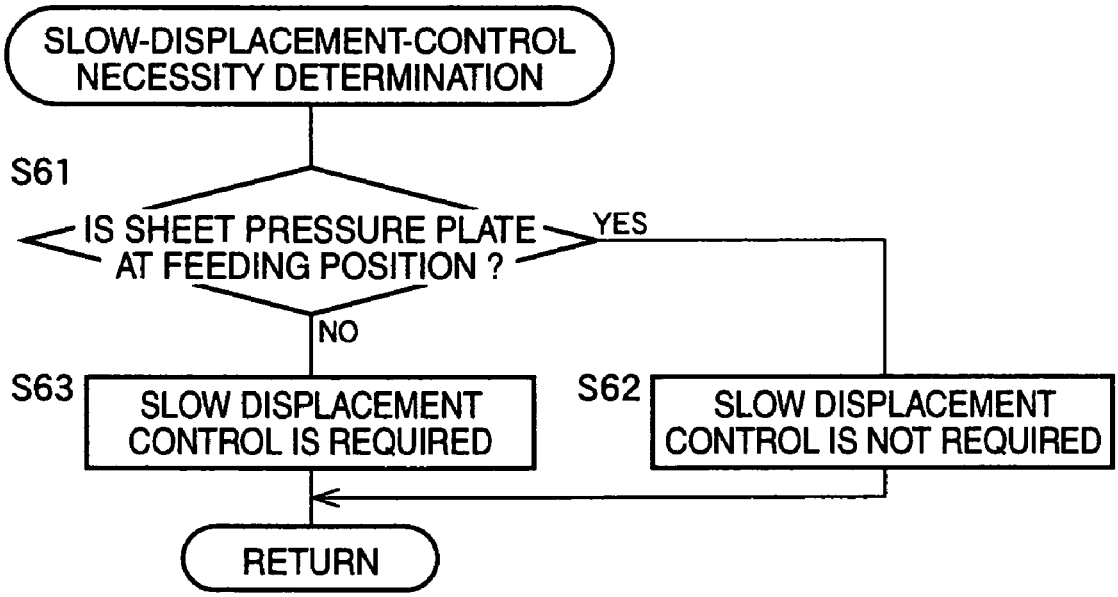
FIG. 15 is a flow chart schematically illustrating a slow-displacement-control necessity determination routine executed for making a determination as to whether or not a CPU of a laser printer according to a fourth embodiment of the present invention is required to perform a slow displacement control, the determination being made based on an output of a sensor for detecting whether or not a sheet pressure plate is located at a feeding position.

In the present embodiment, the CPU 103 executes a slow-displacement-control necessity determination routine schematically illustrated in flow chart in FIG. 15, instead of that illustrated in FIG. 10.

In the slow-displacement-control necessity determination routine shown in FIG. 15, a step S61 is implemented to make a determination as to whether or not the pressure plate position sensor 116 detects the sheet pressure plate 15 located at the feeding position. If the pressure plate position sensor 116 detects the sheet pressure plate 15 located at the feeding position, then the determination of the step S61 becomes affirmative "YES," and the CPU 103 proceeds to a step S62 to determine that, because there is no need of displacing the sheet pressure plate 15 from the receiving position to the feeding position, the slow displacement control is not required.

In contrast, if the pressure plate position sensor 116 fails to detect the sheet pressure plate 15 located at the feeding position, which is to say, if the sheet pressure plate 15 is not located at the feeding position, then the determination of the step S61 becomes negative "NO," and the CPU 103 proceeds to a step S63 to determine that the slow displacement control is required.

As will be evident from the above, the present embodiment enables an accurate detection as to whether or not the sheet pressure plate 15 is located at the feeding position, by virtue of the pressure plate position sensor 116, resulting in an improved determination as to whether or not the slow displacement control is required.

It is added that, although the third embodiment described above is obtained by making such modifications to the first embodiment that the output of the tray sensor 114 enters the CPU 103 as shown in phantom line in FIG. 11, and the CPU 103 implements the step S32 shown in FIG. 12 in a manner shown in FIG. 14, the same or similar modifications may be made to the second embodiment described above.

It is further added that, although the fourth embodiment described above is obtained by making such modifications to the first embodiment that the output of the pressure plate position sensor 116 enters the CPU 103 as shown in phantom line in FIG. 11, and the CPU 103 implements the step S32 shown in FIG. 12 in a manner shown in FIG. 15, the same or similar modifications may be made to the second embodiment described above.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. An apparatus for forming an image on a recording medium, comprising:

a first drive source;

a photoreceptor driven for movement by a driving force applied thereto from the first drive source;

a support member supporting the recording medium to be fed toward the photoreceptor, displaceable between a receiving position allowing reception of the recording medium on the support member, and a feeding position allowing feeding of the recording medium from the support member toward the photoreceptor; and a drive mechanism operable by a driving force applied thereto from the first drive source to displace the support member from the receiving position to the feeding position.

2. The apparatus according to claim 1, wherein the drive mechanism selectively employs the driving force applied from the first drive source, depending on a position of the support member, to thereby displace the support member toward the feeding position.

3. The apparatus according to claim 2, wherein the support member receives a stack of a plurality of recording sheets, each corresponding to the recording medium, and wherein the drive mechanism comprises:

an input member driven by the first drive source;

an output member allowing displacement of the support member;

a clutch disposed between the input member and the output member, operable to be selectively switched to a state allowing transmission of a driving force of the input member to the output member, and a state not allowing the transmission; and an actuator operable to switch the operation state of the clutch depending on a position of an uppermost one of the plurality of recording sheets stacked on the support member.

4. The apparatus according to claim 3, wherein the input member comprises an input shaft rotated about an axis thereof, wherein the clutch comprises a reducer of an eccentric differential type having an external gear and an internal gear which are different in number of teeth from each other and which mesh eccentrically with each other, and wherein the actuator selectively switches a relative geometry between the external and internal gears into a geometry allowing a relative rotation therebetween and a geometry not allowing the relative rotation.

5. The apparatus according to claim 4, wherein the external gear is rotatable relative to the input shaft in eccentric relation thereto, and is mechanically engaged with the output shaft, wherein the internal gear is rotatable coaxially with the input shaft, and meshes with the external gear with the internal gear being larger in number of teeth than the external gear, and wherein the actuator selectively switches a state of the internal gear into a state not allowing an integral rotation of the internal and external gears, and a state allowing the integral rotation.

6. The apparatus according to claim 1, further including a controller controlling a driving speed of the first drive source to achieve a first driving speed while the recording medium is being fed, and a second driving speed lower than the first driving speed while the support member is being displaced from the receiving position to the feeding position.

7. The apparatus according to claim 6, further comprising:

a second drive source; and an optical element driven by the second drive source for scanning the photoreceptor with laser light, to thereby form an electrostatic latent image on the photoreceptor, wherein the photoreceptor carries thereon a developer image resulting from development of the electrostatic latent image, wherein the developer image is transferred from the photoreceptor to the recording medium delivered to the photoreceptor, at a point of time of transfer established based on a length of a scanning readiness period elapsed from a time at which a driving operation of the second drive source starts to a time at which the driving speed of the second drive source reaches a speed allowing scanning of the photoreceptor with the laser light using the optical element, wherein feed of the recording medium from the support member toward the photoreceptor starts at a start time of feed allowing that the recording medium reaches the photoreceptor by the point of time of transfer, and wherein displacement of the support member from the receiving position toward the feeding position at the second driving speed starts at a start time of displacement allowing that the recording medium reaches the feeding position by the start time of feed.

8. The apparatus according to claim 7, wherein the first and second drive sources start respective driving operations at respective different points of time.

9. The apparatus according to claim 7, wherein the start time of displacement and the start time of feed are each established to be reached within the scanning readiness period.

10. The apparatus according to claim 9, further comprising:

a transfer device transferring the developer image from the photoreceptor onto the recording medium; and a transfer-bias applicator applying to the transfer device a selected one of a transfer bias and a transfer cleaning bias, wherein the controller applies the transfer cleaning bias to the transfer device via the transfer bias applicator prior to the start time of feed within the scanning readiness period, to thereby complete a cleaning operation for cleaning the transfer device.

11. The apparatus according to claim 10, wherein the controller applies the transfer bias to the transfer device via the transfer bias applicator concurrently with or after the start time of feed.

12. The apparatus according to claim 7, further comprising a cleaner cleaning the photoreceptor by applying a photoreceptor cleaning bias to the photoreceptor, wherein the controller applies the photoreceptor cleaning bias to the photoreceptor via the cleaner prior to the start time of feed within the scanning readiness period.

13. The apparatus according to claim 7, wherein the controller switches the driving speed of the first drive source from the second driving speed to the first driving speed, upon completion of displacement of the support member to the feeding position, by the start time of feed of the recording medium.

14. The apparatus according to claim 6, wherein the controller controls the driving speed of the first drive source to achieve the first driving speed with the support member being located at the feeding position.

15. The apparatus according to claim 14, further comprising:

a storage storing a developer material for developing an electrostatic latent image formed on the photoreceptor; and an agitator agitating the developer material stored in the storage, wherein the controller determines that the support member is located at the feeding position within a predetermined length of time elapsed after operation of the agitator for warming up the storage.

16. The apparatus according to claim 14, wherein the controller determines that the support member is located at the feeding position within a predetermined length of time elapsed after operation of the apparatus for forming an image on the recording medium.

17. The apparatus according to claim 14, further comprising:

a tray detachably mounted in the apparatus and accommodating the support member; and a first sensor selectively detecting a presence of the tray in the apparatus and an absence of the tray from the apparatus, wherein the controller determines that the support member is located at the feeding position while the first sensor detects the presence of the tray in the apparatus.

18. The apparatus according to claim 14, further comprising a second sensor detecting a presence of the support member at the feeding position, wherein the controller determines that the support member is located at the feeding position while the second sensor detects the presence of the support member at the feeding position.

19. The apparatus according to claim 1, further comprising a transmission controlling mechanism preventing transmission of the driving force of the first drive source to the drive mechanism, in response to completion of displacement of the support member to the feeding position by the drive mechanism.

20. The apparatus according to claim 1, further comprising:

a tray detachably mounted in the apparatus and accommodating the support member; and a feeding element feeding the recording medium on the support member toward the photoreceptor, wherein the support member is accommodated in the tray and is selectively displaced to the feeding position and the receiving position, wherein the support member is closer at the feeding position to the feeding element than that at the receiving position, and wherein the feeding element is brought into contact with an uppermost one of a plurality of recording sheets each corresponding to the recording medium stacked on the support member.

21. The apparatus according to claim 20, wherein the feeding element comprises a pick-up roller picking up and feeding out the uppermost recording sheet from the tray because of rotation of the pick-up roller in contact with the uppermost recording sheet.

* * * * *